US008199079B2

(12) United States Patent
Kim et al.

(10) Patent No.: US 8,199,079 B2
(45) Date of Patent: Jun. 12, 2012

(54) DEMULTIPLEXING CIRCUIT, LIGHT EMITTING DISPLAY USING THE SAME, AND DRIVING METHOD THEREOF

(75) Inventors: Yang Wan Kim, Seoul (KR); Yong Sung Park, Seoul (KR); Bo Yong Chung, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1217 days.

(21) Appl. No.: 11/197,752

(22) Filed: Aug. 3, 2005

(65) Prior Publication Data

US 2006/0107146 A1 May 18, 2006

(30) Foreign Application Priority Data

Aug. 25, 2004 (KR) ..... 10-2004-0067283
Aug. 25, 2004 (KR) ..... 10-2004-0067285

(51) Int. Cl.
*G09G 3/30* (2006.01)

(52) U.S. Cl. ..... 345/77; 370/536

(58) Field of Classification Search ..... 345/76, 345/77, 87, 204
See application file for complete search history.

(56) References Cited

U.S. PATENT DOCUMENTS 5,892,493 A 4/1999 Enami et al.
6,501,227 B1 * 12/2002 Koyama ..... 315/169.3
6,859,193 B1 * 2/2005 Yumoto ..... 345/82
7,057,589 B2 6/2006 Shin et al.
2002/0118150 A1 * 8/2002 Kwon ..... 345/76

(Continued)

FOREIGN PATENT DOCUMENTS

CN 1447302 A 10/2003

(Continued)

OTHER PUBLICATIONS

Office action, and English translation, dated Nov. 9, 2007 for the corresponding Chinese patent application No. 2005100921248.

(Continued)

*Primary Examiner* — Yong H Sim
(74) *Attorney, Agent, or Firm* — Christie, Parker & Hale, LLP

(57) ABSTRACT

A demultiplexing circuit, a light emitting display using the same, and a driving method thereof, in which the number of output lines provided in a data driver is reduced. The light emitting display includes: a scan driver for supplying scan signals to scan lines in sequence; a data driver provided with a plurality of output lines and for supplying a plurality of data signals to the respective output lines while the scan signals are supplied; an image displaying part comprising a plurality of pixels placed in regions sectioned by the scan lines and a plurality of data lines; a plurality of demultiplexers, each of the demultiplexers coupling a respective one the output lines and having a plurality of data transistors adapted to supply a respective one of the data signals from the respective one of the output lines to more than one of the plurality of data lines; and a plurality of initializers having a plurality of initialization transistors adapted to apply a predetermined voltage to each of the plurality of data lines. In one embodiment, at least one of the initialization transistors is kept turned on until a respective one of the data transistors connected to the same data line connected to the at least one of initialization transistors is turned on, thereby supplying a desired data signal to a respective one of the pixels.

30 Claims, 18 Drawing Sheets

U.S. PATENT DOCUMENTS

| | | | | |
|---|---|---|---|---|
| 2002/0196240 | A1* | 12/2002 | Hajime et al. | 345/204 |
| 2003/0085885 | A1 | 5/2003 | Nakayoshi et al. | |
| 2003/0179164 | A1* | 9/2003 | Shin et al. | 345/76 |
| 2004/0041744 | A1* | 3/2004 | Inoue et al. | 345/1.3 |
| 2004/0140969 | A1* | 7/2004 | Morita | 345/204 |
| 2004/0145547 | A1* | 7/2004 | Oh | 345/76 |
| 2004/0150599 | A1* | 8/2004 | Morita | 345/87 |
| 2005/0024297 | A1 | 2/2005 | Shin | |

FOREIGN PATENT DOCUMENTS

| | | | |
|---|---|---|---|
| JP | 11-38946 | | 2/1999 |
| JP | 2000-105574 | | 4/2000 |
| JP | 2001-312243 | | 11/2001 |
| JP | 2002-149125 | | 5/2002 |
| JP | 2002-215096 | | 7/2002 |
| JP | 2002-333866 | | 11/2002 |
| JP | 2003-076327 | | 3/2003 |
| JP | 2003-114645 | | 4/2003 |
| JP | 2003-150112 | | 5/2003 |
| JP | 2003-195812 | | 7/2003 |
| JP | 2003-308045 | | 10/2003 |
| JP | 2004-029528 | | 1/2004 |
| JP | 2004-118196 | | 4/2004 |
| WO | WO 01/06484 | A1 | 1/2001 |
| WO | WO 02/39420 | A1 | 5/2002 |
| WO | WO 03/091977 | | 11/2003 |
| WO | WO 03/091978 | | 11/2003 |
| WO | WO 03/091979 | | 11/2003 |

OTHER PUBLICATIONS

Japanese Office action dated Nov. 25, 2008, for corresponding Japanese application 2005-236879.

Patent Gazette dated Mar. 18, 2009 for corresponding Chinese Patent Application No. 200510092124.8.

Japanese Office action dated Jun. 15, 2010, for corresponding Japanese Patent application 2005-2236879.

Japanese Office action dated Nov. 16, 2010, for corresponding Japanese Patent application 2005-236879.

* cited by examiner

DEMULTIPLEXING CIRCUIT, LIGHT EMITTING DISPLAY USING THE SAME, AND DRIVING METHOD THEREOF

CROSS-REFERENCE TO RELATED APPLICATIONS

This application claims priority to and the benefit of Korean Patent Application Nos. 10-2004-0067283 and 10-2004-0067285, filed on Aug. 25, 2004, in the Korean Intellectual Property Office, the entire contents of all of which are incorporated herein by reference.

BACKGROUND OF THE INVENTION

1. Field of the Invention

The present invention relates to a demultiplexing circuit, a light emitting display using the same, and a driving method thereof, and more particularly, to a demultiplexing circuit, a light emitting display using the same, and a driving method thereof, in which the number of output lines provided in a data driver is reduced.

2. Description of Related Art

Recently, various flat panel displays have been developed to substitute for a cathode ray tube (CRT) display because the CRT display is relatively heavy and bulky. A flat panel display can be a liquid crystal display (LCD), a field emission display (FED), a plasma display panel (PDP), a light emitting display (LED), etc. Among the flat panel displays, a light emitting display can emit light by itself through an electron-hole recombination. Such a light emitting display has advantages of a relatively fast response time and a relatively low power consumption. Generally, a light emitting display employs a thin film transistor (TFT) provided in each pixel for supplying a current corresponding to a data signal to a light emitting device or diode (LED), thereby allowing the light emitting device to emit light.

FIG. 1 is a plan view of a conventional light emitting display.

Referring to FIG. 1, the conventional light emitting display includes an image displaying part 30 having a plurality of pixels 40 formed adjacent to a region where a plurality of scan lines S1 through Sn and a plurality of data lines D1 through Dm are crossed with each other; a scan driver 10 to drive the scan lines S1 through Sn; a data driver 20 to drive the data driver D1 through Dm; and a timing controller 50 to control the scan driver 10 and the data driver 20.

The scan driver 10 generates a scan signal (or scan signals) in response to a scan control signal SCS transmitted from the timing controller 50, and supplies the scan signal (or the scan signals) to the scan lines S1 through Sn in sequence. Further, the scan driver 10 generates an emission control signal (or emission control signals) in response to the scan control signal SCS, and supplies the emission control signal (or the emission control signals) to emission control lines E1 through En in sequence.

The data driver 20 generates a data signal (or data signals) in response to a data control signal DCS transmitted from the timing controller 50, and supplies the data signal (or the data signals) to the data lines D1 through Dm. That is, the data driver 20 supplies the data signal corresponding to one horizontal line per horizontal period to the data lines D1 through Dm.

The timing controller 50 generates the data control signal DCS and the scan control signal SCS in response to external synchronization signals. Here, the data control signal DCS is transmitted to the data driver 20, and the scan control signal SCS is transmitted to the scan driver 10. Further, the timing controller 50 rearranges external data Data and supplies it to the data driver 20.

The image displaying part 30 receives an external first power (e.g., a first voltage) from a first power source (or line) VDD and an external second power (e.g., a second voltage) from a second power source (or line) VSS. Here, the first power from the first power source VDD and the second power from the second power source VSS are supplied to the respective pixels 40. Each pixel 40 receives the data signal and displays an image corresponding to the data signal. Further, the emission time of the pixels 40 is controlled in correspondence with the emission control signal.

In the conventional light emitting display, the respective pixels 40 are placed in the regions where the scan lines S1 through Sn and the data lines D1 through Dm are crossed with each other. Here, the data driver 20 includes m output lines to supply the data signals to m data lines D1 through Dm. That is, the data driver 20 of the conventional light emitting display should have the same number of output lines as the number of the data lines D1 through Dm. The data driver 20 includes a plurality of data integrated circuits for the m output lines that increase a production cost of the display. Particularly, the higher the resolution and the larger the size of the image displaying part 30 are, the more the number of output lines of the data driver 20 increases. Thus, the production cost of the light emitting display is increased.

SUMMARY OF THE INVENTION

Accordingly, an embodiment of the present invention provides a demultiplexing circuit, a light emitting display using the same, and a driving method thereof, in which the number of output lines provided in a data driver is reduced.

One embodiment of the present invention provides a light emitting display. The light emitting display includes: a scan driver for supplying scan signals to scan lines in sequence; a data driver provided with a plurality of output lines (or first data lines) and for supplying a plurality of data signals to the respective output lines while the scan signals are supplied; an image displaying part having a plurality of pixels placed in regions sectioned by the scan lines and a plurality of data lines (or second data lines); a plurality of demultiplexers, each of the demultiplexers coupling a respective one of the output lines and comprising a plurality of data transistors adapted to supply a respective one of the data signals from the respective one of the output lines to more than one of the plurality of data lines; and a plurality of initializers having a plurality of initialization transistors adapted to apply a predetermined voltage to each of the plurality of data lines.

In one embodiment of the invention, each of the pixels includes a plurality of pixel transistors, and at least one of the pixel transistors is connected to function as a diode. Further, in one embodiment, the light emitting display includes a demultiplexer controller for controlling the demultiplexers to supply the plurality of data signals from each of the output lines to the plurality of data lines. Also, in one embodiment, the number of data transistors provided in each of the demultiplexers is equal to the number of initialization transistors provided in each of the initializers. Further, in one embodiment, the demultiplexer controller supplies control signals to turn on the plurality of data transistors in sequence while at least one of the scan signals is supplied. Also, in one embodiment, the demultiplexer controller supplies initialization control signals to turn on the initialization transistors in each of the initializers before the data transistors in a respective one of the demultiplexer are turned on.

One embodiment of the present invention provides a demultiplexing circuit. The demultiplexing circuit includes: a plurality of demultiplexers respectively coupled to a plurality of output lines of a data driver and having a plurality of data transistors adapted to supply a data signal from each of the output lines to more than one of a plurality of data lines; and a plurality of initializers having a plurality of initialization transistors adapted to supply a predetermined voltage to each of the plurality of data lines.

In one embodiment, the number of data transistors provided in each of the demultiplexers is equal to the number of initialization transistors provided in each of the initializers. Further, in one embodiment, the data transistors provided in each of the demultiplexers are turned on in sequence to supply the plurality of data signals to the plurality of data lines. Also, in one embodiment, the initialization transistors provided in each of the initializers are turned on before the data transistors in a respective one of the demultiplexers are turned one, and the initialization transistors provided in each of the initalizers are turned off at different times.

One embodiment of the present invention provides a method of driving a light emitting display The method includes: supplying scan signals to a plurality of scan lines in sequence; supplying a plurality of data signals to respective output lines of a data driver while the scan signal is supplied; turning on a plurality of data transistors connected to the respective output lines in sequence to supply the plurality of data signals to a plurality of data lines; and turning on a plurality of initialization transistors connected to the plurality of data lines before turning on the data transistors to supply an initialization power to the plurality of data lines.

In one embodiment, the initialization transistors are turned off at different times.

BRIEF DESCRIPTION OF THE DRAWINGS

These and/or other aspects of the invention will become apparent and more readily appreciated from the following description of the exemplary embodiments, taken in conjunction with the accompanying drawings of which.

DETAILED DESCRIPTION

Hereinafter, exemplary embodiments according to the present invention will be described with reference to the accompanying drawings. The exemplary embodiments of the present invention are provided to be readily understood by those skilled in the art.

Figure 1:
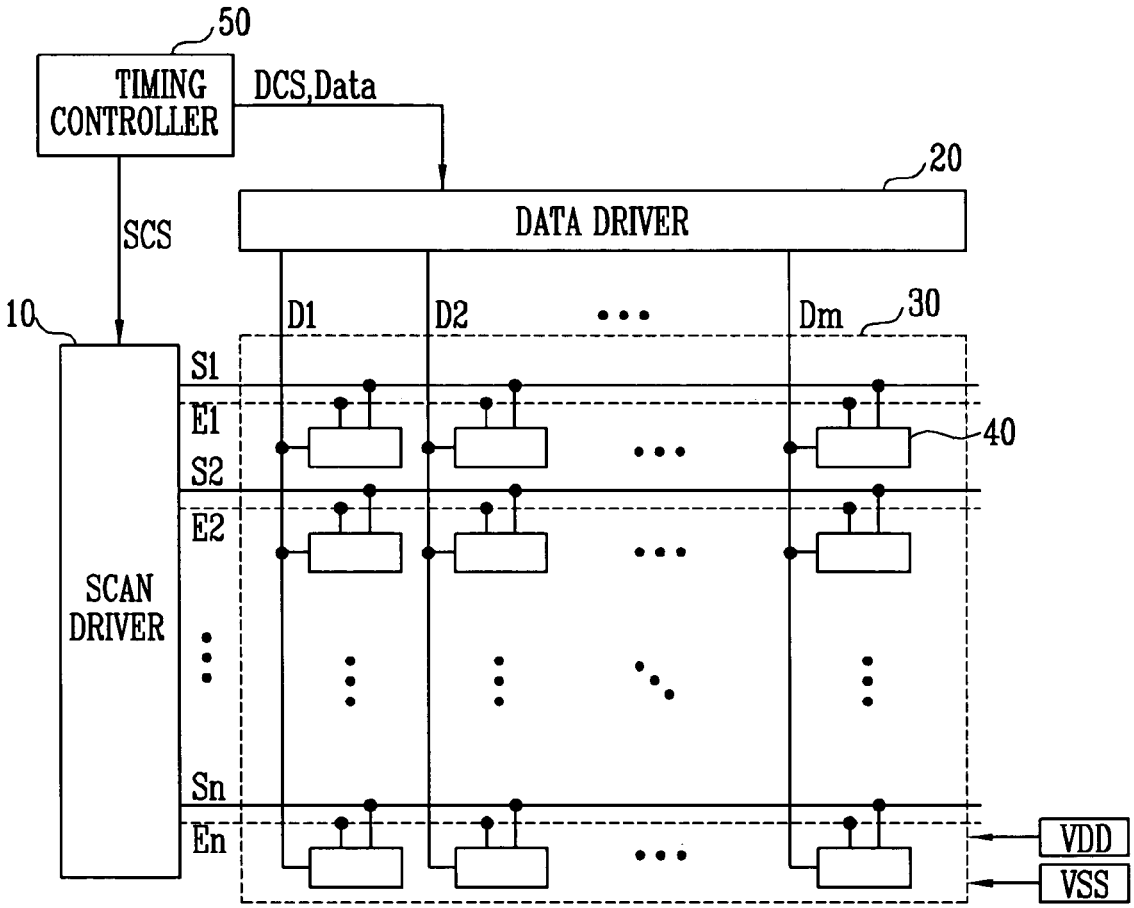
FIG. 1 (PRIOR ART)
FIG. 1 is a plan view of a conventional light emitting display.
Figure 2:
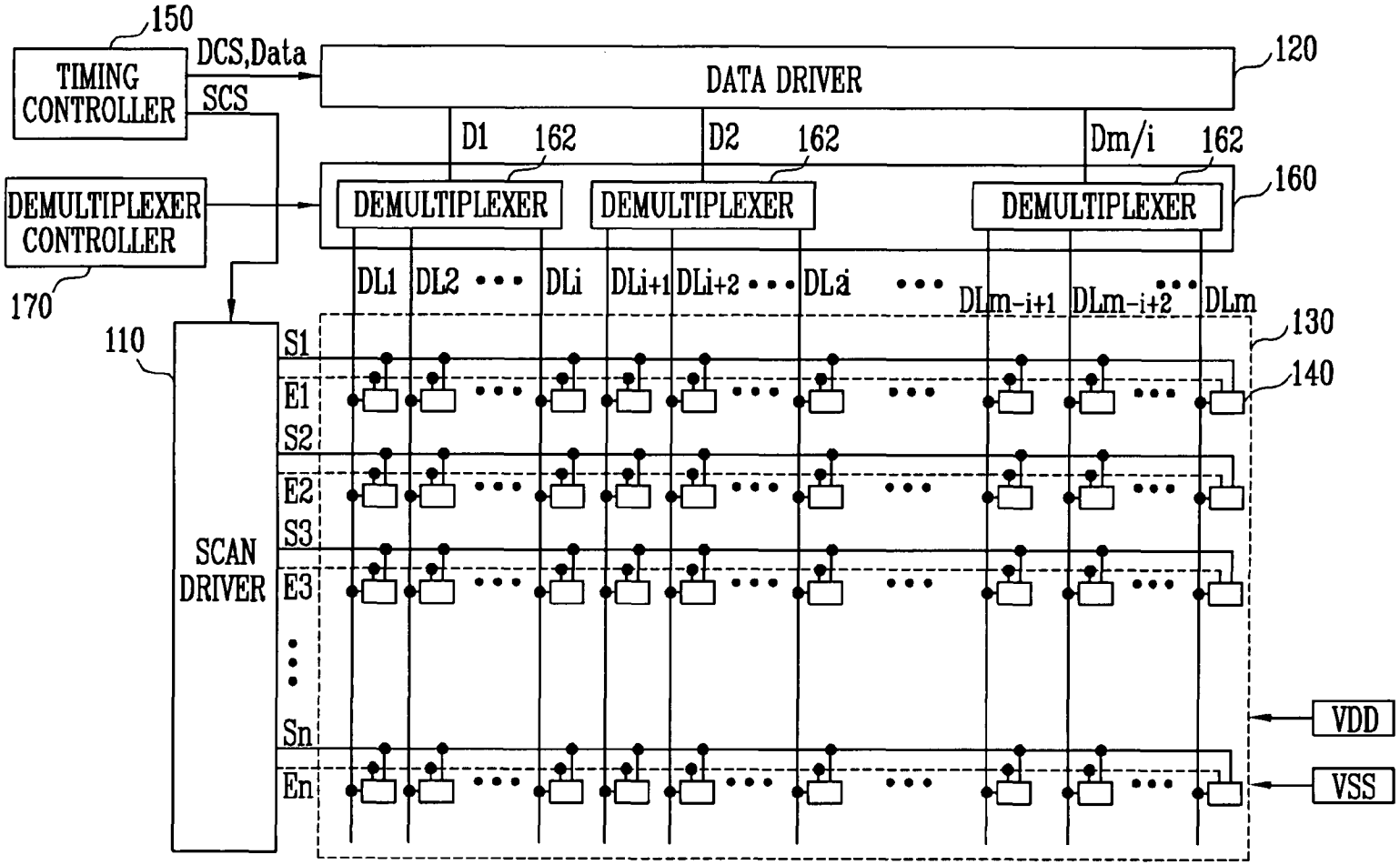
FIG. 2 is a plan view of a light emitting display according to a first embodiment of the present invention.

FIG. 2 is a plan view of a light emitting display according to a first embodiment of the present invention.

Referring to FIG. 2, a light emitting display according to the first embodiment of the present invention includes a scan driver 110, a data driver 120, an image displaying part 130, a timing controller 150, a demultiplexing block 160, and a demultiplexer controller 170.

The image displaying part 130 includes a plurality of pixels 140 placed adjacent to regions defined by a plurality of scan lines S1 through Sn and a plurality of second data lines DL1 through DLm. Each pixel 140 emits light corresponding to a data signal transmitted through the second data line DL.

The scan driver 110 generates a scan signal (or scan signals) in response to a scan control signal SCS supplied from the timing controller 150, and supplies the scan signal (or the scan signals) to the scan lines S1 through Sn in sequence. Further, the scan driver 110 generates an emission control signal (or emission control signals) in response to the scan control signal SCS, and supplies the emission control signal (or the emission control signals) to emission control lines E1 through En in sequence.

The data driver 120 generates a data signal (or data signals) in response to a data control signal DCS supplied from the timing controller 150, and supplies the data signal (or the data signals) to a plurality of first data lines D1 through Dm/i. Here, the first data lines D1 through Dm/i are connected to respective output line of the data driver 120, and the data driver 120 supplies i data signals (where i is a natural number of 2 or more) to the first data lines D1 through Dm/i when the scan signal is supplied. That is, the data driver 120 supplies the i data signals per horizontal period.

The timing controller 150 generates the data control signal DCS and the scan control signal SCS corresponding to external synchronization signals. The data control signal DCS generated in the timing controller 150 is supplied to the data driver 120, and the scan control signal SCS generated in the timing controller 150 is supplied to the scan driver 110. Further, the timing controller 150 supplies external data Data to the data driver 120.

The demultiplexer block 160 includes m/i demultiplexers 162. In other words, the demultiplexer block 160 has the same number of demultiplexers 162 as the number of the first data lines D1 through Dm/i, wherein the m/i demultiplexers 162 are connected to the first data lines D1 through Dm/i, respectively.

Further, each of the demultiplexers 162 is connected to i second data lines DL, respectively. Thus, a demultiplexer 162 supplies the data signal received through a first data line D per one horizontal period to i second data lines DL in sequence. That is, one demultiplexer 162 supplies the data signal received through one first data line D to i second data lines DL. Because the data signal received from one first data line D is supplied to i second data lines DL, the number of the output lines provided in the data driver 120 can be decreased. For instance, when i is 3, the number of output lines provided in the data driver 120 is decreased by ⅓, and thus the number of data integrated circuits provided in the data driver 120 is also decreased. That is, according to an embodiment of the present invention, the demultiplexer 162 is employed for supplying the data signal from one first data line D to i second data lines DL, thereby reducing production cost of the light emitting display.

The demultiplexer controller 170 supplies i control signals to the respective demultiplexers 162 per horizontal period. That is, the demultiplexer controller 170 supplies i control signals so that the data signal is supplied from one first data line D to i second data lines DL. In this embodiment, the demultiplexer controller 170 is provided outside the timing controller 150, but, in another embodiment, a demultiplexer controller may be provided inside the timing controller 150.

Figure 3:
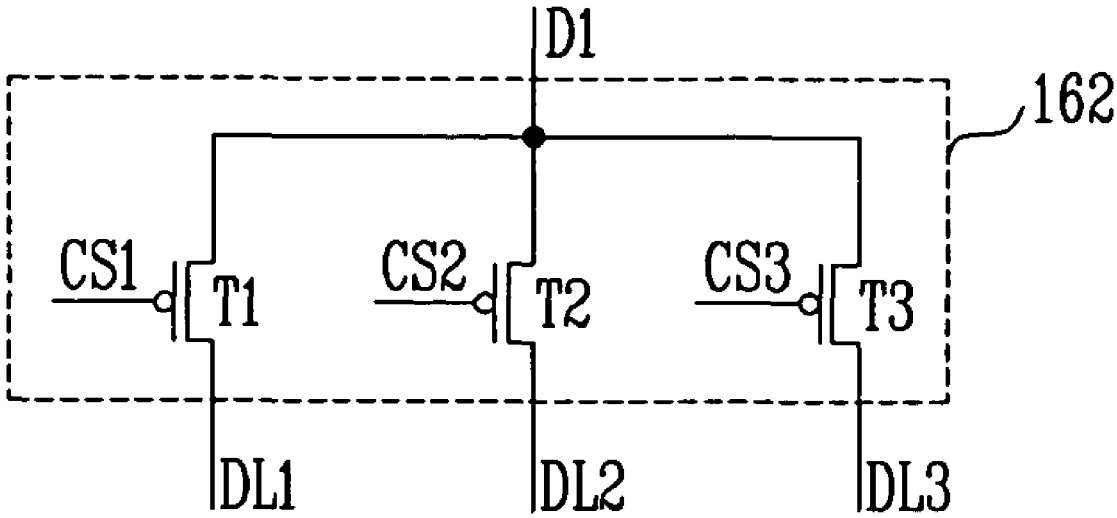
FIG. 3 is a circuit diagram of a demultiplexer provided in the light emitting display according to the first embodiment of the present invention.

FIG. 3 is a circuit diagram of a demultiplexer provided in the light emitting display according to the first embodiment of the present invention. For exemplary purposes only i is equal to 3. Further, the demultiplexer shown in FIG. 3 is connected to the $1^{st}$ first data line D1.

Referring to FIG. 3, each demultiplexer 162 includes a first switching device (or transistor) T1, a second switching device T2, and a third switching device T3.

The first switching device T1 is connected between the $1^{st}$ first data line D1 and the $1^{st}$ second data line DL1, and transmits the data signal from the $1^{st}$ first data line D1 to the $1^{st}$ second data line DL1. Here, the first switching device T1 is driven by the first control signal CS1 supplied from the demultiplexer controller 170.

The second switching device T2 is connected between the $1^{st}$ first data line D1 and the $2^{nd}$ second data line DL2, and transmits the data signal from the $1^{st}$ first data line D1 to the $2^{nd}$ second data line DL2. Here, the second switching device T2 is driven by the second control signal CS2 supplied from the demultiplexer controller 170.

The third switching device T3 is connected between the $1^{st}$ first data line D1 and the $3^{rd}$ second data line DL3, and transmits the data signal from the $1^{st}$ first data line D1 to the $3^{rd}$ second data line DL3. Here, the third switching device T3 is driven by the third control signal CS3 supplied from the demultiplexer controller 170.

With this configuration, operations of the demultiplexer 162 will be described associating with configurations of the pixel 140.

Figure 4:
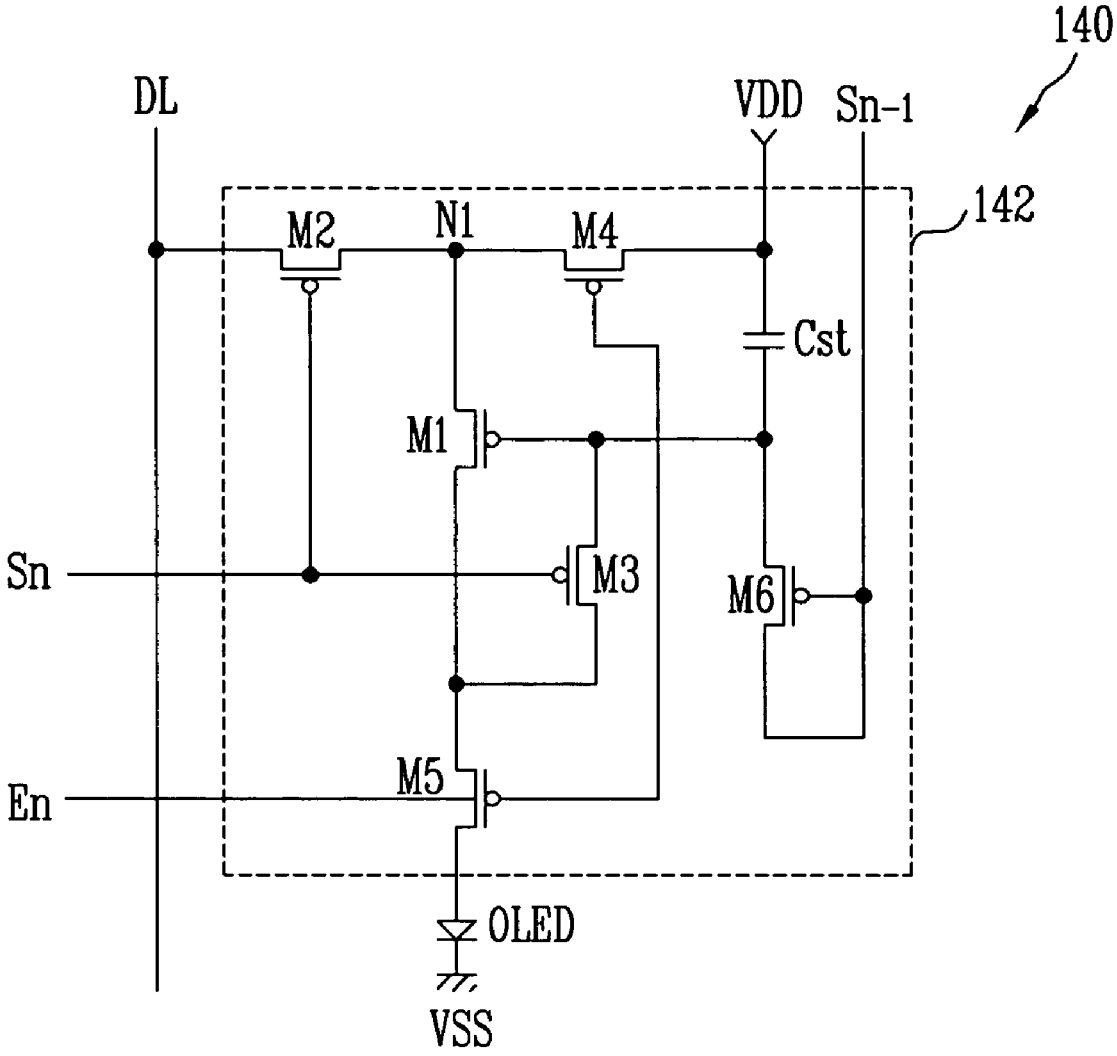
FIG. 4 is a circuit diagram of a pixel provided in the light emitting display according to the first embodiment of the present invention.

FIG. 4 is a circuit diagram of a pixel provided in the light emitting display according to the first embodiment of the present invention. Substantially, the present invention can employ various kinds of pixels as long as it receives an initialization signal before receiving the data signal. Here, at least one of the transistors provided in each pixel 140 is connected to function as a diode.

Referring to FIG. 4, each pixel 140 according to the first embodiment of the present invention includes a light emitting device OLED and a pixel circuit 142. The pixel circuit 142 is connected to the second data line DL, the scan line S (e.g., the scan line Sn and/or the scan line Sn-1), and the emission control line E (e.g., the emission control line En) and is for controlling the light emitting device OLED to emit light.

The light emitting device OLED includes an anode electrode connected to the pixel circuit 142, and a cathode electrode connected to a second power line VSS. The second power line VSS is applied with a second voltage lower than that of a first voltage applied to a first power line VDD. For example, a ground voltage can be applied to the second power line VSS. The light emitting device OLED emits light corresponding to current supplied from the pixel circuit 142. For this, the light emitting device OLED includes fluorescent and/or phosphorescent organic materials.

The pixel circuit 142 includes the storage capacitor Cst and a sixth transistor M6 which are connected between the first power line VDD and the $(n-1)^{th}$ scan line Sn-1; a second transistor M2 and a fourth transistor M4 which are connected between the first power line VDD and the data line DL; a fifth transistor M5 which is connected between the light emitting device OLED and the emission control line En; a first transistor M1 which is connected between the fifth transistor M5 and a first node N1 to which the second electrode M2 and the fourth transistor M4 are commonly connected; and a third transistor M3 connected between a gate terminal and a drain terminal of the first transistor M1. In FIG. 4, the first through sixth transistors M1 through M6 are of a p-type metal oxide semiconductor field effect transistor (PMOSFET), but the present invention is not thereby limited.

The first transistor M1 includes a source terminal connected to the first node N1, the drain terminal connected to a source terminal of the fifth transistor M5, and the gate terminal connected to the storage capacitor Cst. Further, the first transistor M1 supplies a current corresponding to a voltage charged in the storage capacitor Cst to the light emitting device OLED.

The third transistor M3 includes a drain terminal connected to the gate terminal of the first transistor M1, a source terminal connected to the drain terminal of the first transistor M1, and a gate terminal connected to the $n^{th}$ scan line Sn. Further, the third transistor M3 is turned on when the scan signal is transmitted to the $n^{th}$ scan line Sn to thereby make the first transistor M1 function as a diode. That is, when the third transistor M3 is turned on, the first transistor M1 functions as a diode.

The second transistor M2 includes a source terminal connected to the data line DL, a drain terminal connected to the first node N1, and a gate terminal connected to the $n^{th}$ scan line Sn. Further, the second transistor M2 is turned on when the scan signal is transmitted to the $n^{th}$ scan line Sn, thereby transmitting the data signal from the data line DL to the first node N1.

The fourth transistor M4 includes a drain terminal connected to the first node N1, a source terminal connected to the first power line VDD, and a gate terminal connected to the emission control line En. Further, the fourth transistor M4 is turned on when the emission control signal is not supplied, thereby electrically connecting the first power line VDD with the first node N1.

The fifth transistor M5 includes the source terminal connected to the drain terminal of the first transistor M1, a drain terminal connected to the light emitting device OLED, and a gate terminal connected to the emission control line E. Further, the fifth transistor M5 is turned on when the emission control signal is not supplied, thereby supplying current from the first transistor M1 to the light emitting device OLED.

The sixth transistor M6 includes a source terminal connected to the storage capacitor Cst, and drain and gate terminals connected to the $(n-1)^{th}$ scan line Sn-1. Further, the sixth transistor M6 is turned on when the scan signal is transmitted to the $(n-1)^{th}$ scan line Sn-1, thereby initializing the storage capacitor Cst and the gate terminal of the first transistor M1.

Figure 5:
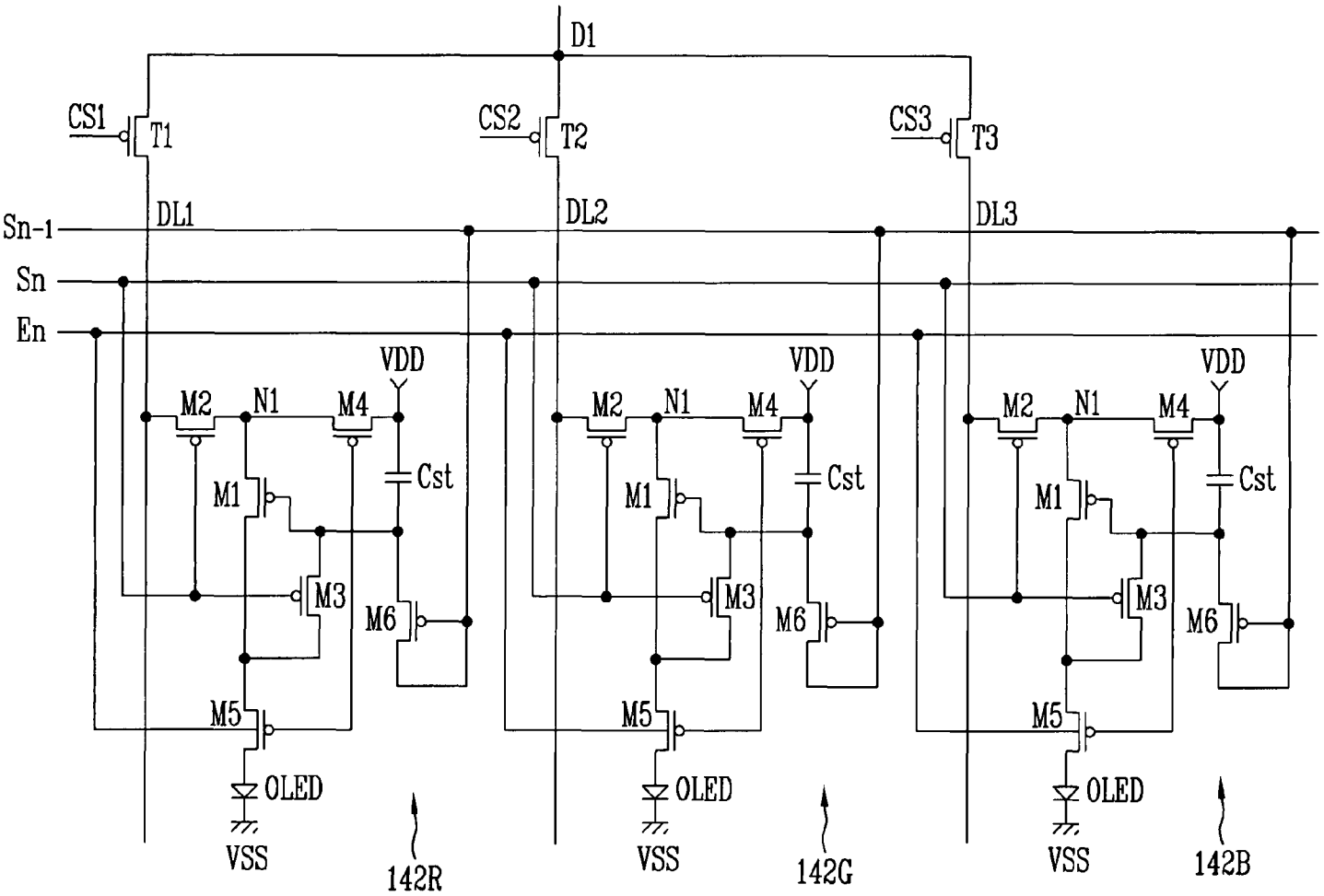
FIG. 5 is a circuit diagram showing connection between the demultiplexer of FIG. 3 and the pixel of FIG. 4.
Figure 6:
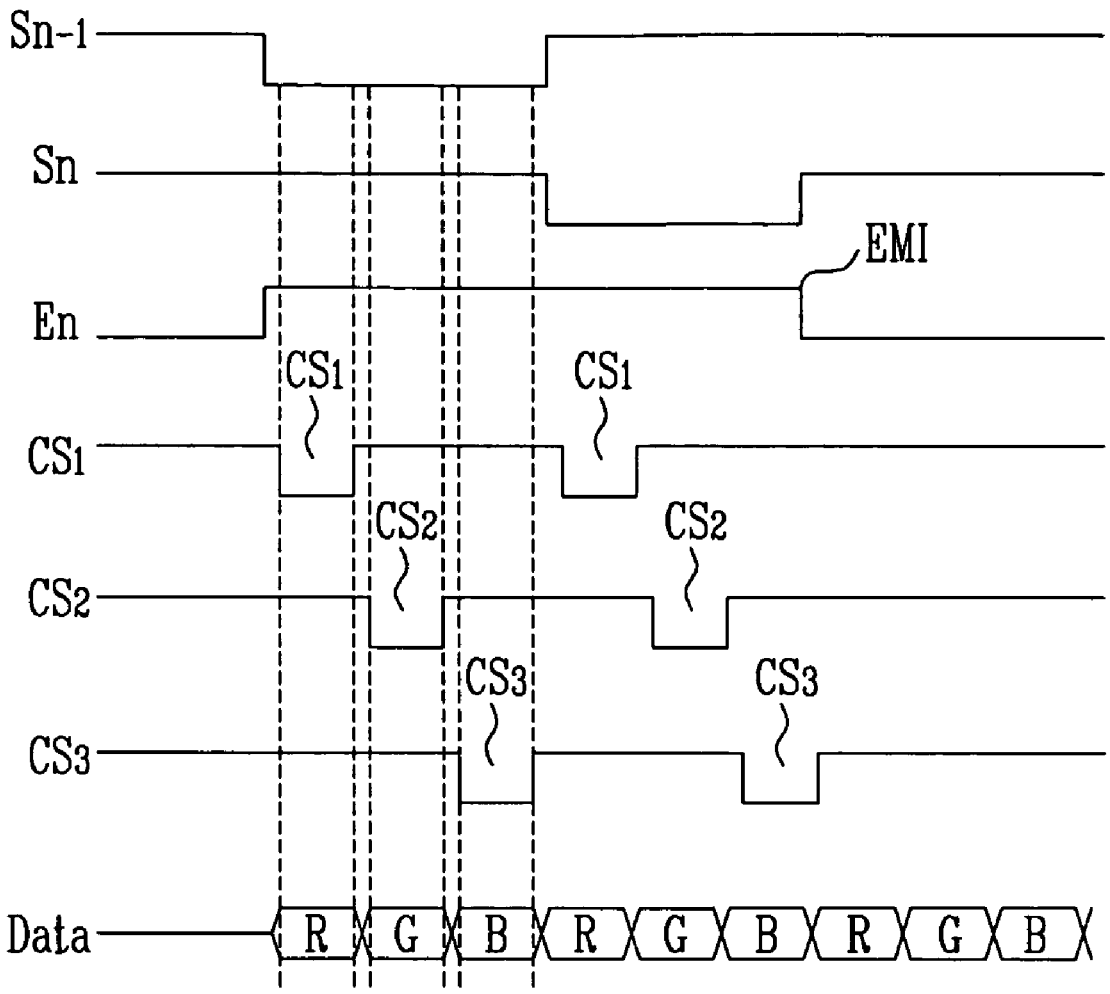
FIG. 6 illustrates waveforms of drive signals supplied to the demultiplexer and the pixel provided in the light emitting display according to the first embodiment of the present invention.

FIG. 5 is a circuit diagram showing a connection between the demultiplexer of FIG. 3 and the pixel of FIG. 4. For exemplary purposes, one demultiplexer is shown to be connected with pixels of red (R), green (G) and blue (B), that is, i is equal to 3. FIG. 6 illustrates waveforms of drive signals supplied to the scan line, the data line, and the demultiplexer provided in the light emitting display according to the first embodiment of the present invention.

Referring to FIGS. 5 and 6, when the scan signal is transmitted to the $(n-1)^{th}$ scan line Sn-1, each sixth transistor M6 of the pixels 142R, 142G and 142B is turned on. Accordingly, as the sixth transistor M6 is turned on, the storage capacitor Cst and the gate terminal of the first transistor M1 are connected to the $(n-1)^{th}$ scan line Sn-1. That is, when the scan signal is transmitted to the $(n-1)^{th}$ scan line Sn-1, the scan signal is supplied to each storage capacitor Cst and each gate terminal of the first transistor M1 provided in the pixels 142R, 142G and 142B, thereby initializing each storage capacitor Cst and each gate terminal of the first transistor M1. In this embodiment, the scan signal has a voltage level lower than that of the data signal.

When the scan signal is transmitted to the $(n-1)^{th}$ scan line Sn-1, the first through third switching devices T1 through T3 are turned on in sequence, so that the data signals are transmitted to the $1^{st}$ second data line DL1 through the $3^{rd}$ second data line DL3. At this time, the second transistor M2 is turned off, so that the data signal is not supplied to the pixels 142R, 142G, 142B.

Then, the scan signal is transmitted to the $n^{th}$ scan line Sn. When the scan signal is transmitted to the $n^{th}$ scan line Sn, each second transistor M2 and each third transistor M3 of the pixels 142R, 142G and 142B are turned on. After each second transistor M2 and each third transistor M3 of the pixels 142R, 142G and 142B are turned on, the first switching device T1 is turned on again by the first control signal cS1.

When the first switching device T1 is turned on, the data signal is transmitted from the $1^{st}$ first data line D1 to the first node N1 of the first pixel 142R via the first switching device T1. At this time, because the voltage applied to the gate terminal of the first transistor M1 is initialized by the scan signal transmitted to the $(n-1)^{th}$ scan line Sn-1, i.e., is set to have a voltage level lower than that of the data signal applied to the first node N1, the first transistor M1 is turned on. Because the first transistor M1 is turned on, the data signal applied to the first node N1 is transmitted to one terminal of the storage capacitor Cst via the first transistor M1 and the third transistor M3. At this time, the storage capacitor Cst is charged with voltage corresponding to the data signal. Further, the storage capacitor Cst is charged with voltage corresponding to the threshold voltage of the first transistor M1 in addition to the voltage corresponding to the data signal.

Then, the first switching device T1 is turned off, and the second and third switching devices T2 and T3 are turned on in sequence, thereby the data signals are transmitted to the second pixel 142G and the third pixel 142B in sequence.

Thus, according to an embodiment of the present invention, the demultiplexer 162 is employed for supplying the data signal from one first data line D1 to i second data lines DL. However, in the light emitting display according to the first embodiment of the present invention, the data signal may not be supplied to a predetermined (or desired) pixel 142.

In more detail and referring to FIG. 5, while the first switching device T1 is turned on, the storage capacitor Cst of the first pixel 142R is charged with the voltage corresponding to the data signal as described above. In this embodiment, while the first switching device T1 is turned on, each second transistor M2 and each third transistor M3 of the second and third pixels 142G and 142B are also turned on by the scan signal transmitted to the $n^{th}$ scan line Sn.

While the second and third transistors M2 and M3 of the second pixel 142G are turned on, the gate terminal of the first transistor M1 is electrically connected to the $2^{nd}$ second data line DL2. In this embodiment, the $2^{nd}$ second data line DL2 is connected with a parasitic capacitor or the like, thereby keeping the voltage of the data signal supplied during a previous period (previous field or previous frame). Thus, the voltage applied to the gate terminal of the first transistor M1 is changed into the voltage of the data signal transmitted during the previous period. That is, the voltage initialized by the scan signal transmitted to the $(n-1)^{th}$ scan line Sn-1 is changed into the voltage of the data signal transmitted during the previous period.

Then, the second switching device T2 is turned on by the second control signal CS2. When the second switching device T2 is turned on, the data signal is transmitted from the $1^{st}$ first data line D1 to the $2^{nd}$ second data line DL2. Then, the data signal is transmitted from the $2^{nd}$ second data line DL2 to the first node N1 via the second transistor M2 of the second pixel 142G. In this embodiment, the first node N1 is applied with the voltage corresponding to the current data signal, and the gate terminal of the first transistor M1 is applied with the voltage corresponding to the previous data signal. In this case, the first transistor M1 is turned on only when the voltage applied to the first node N1 is higher than the sum of the voltage of the previous data signal and the threshold voltage of the first transistor M1, and is turned off otherwise.

As such, according to the first embodiment of the present invention, while the demultiplexer 162 operates, the voltage applied to the gate terminal of each first transistor M1 provided in the second and third pixels 142G and 142B is changed, so that the data signal may not have a desired voltage and thus it may be difficult to properly display a desired image.

Figure 7:
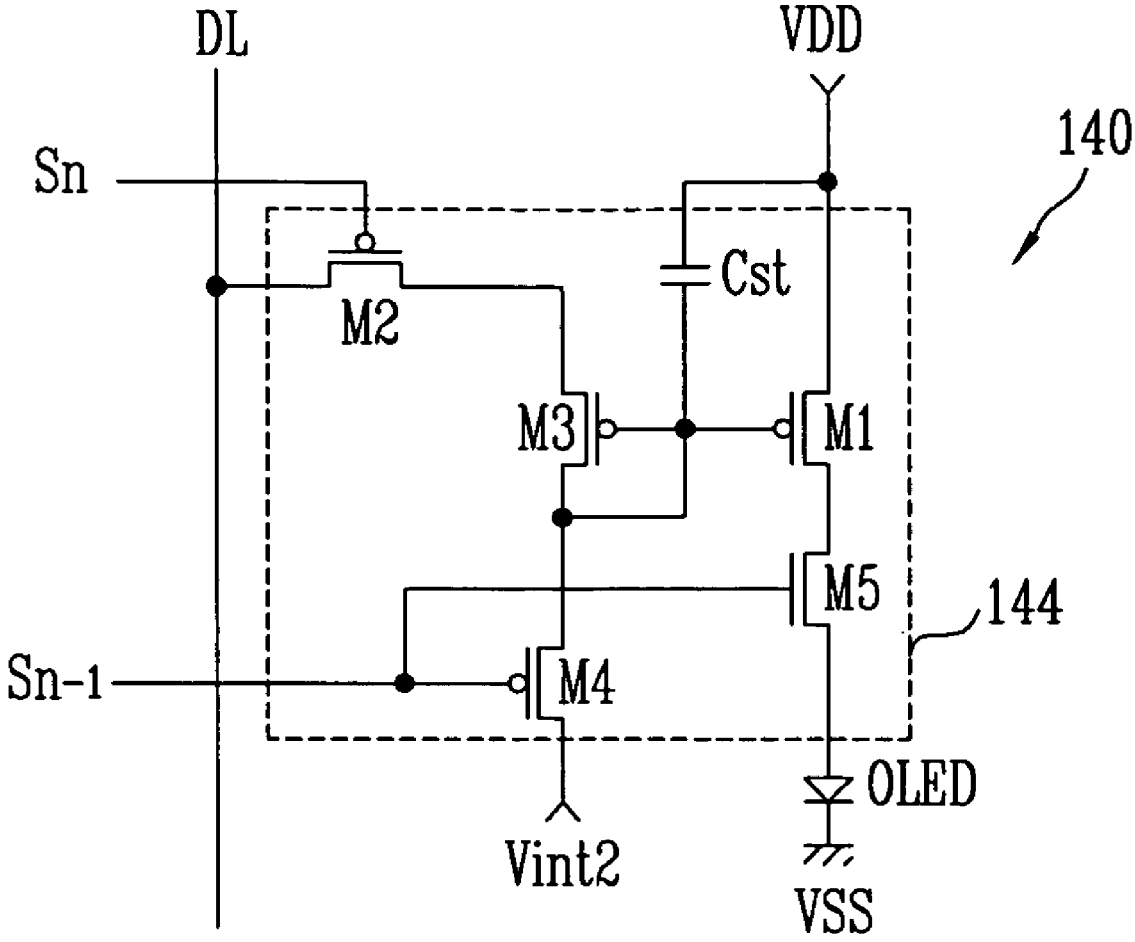
FIG. 7 is a circuit diagram of a pixel provided in a light emitting display according to a second embodiment of the present invention.

FIG. 7 is a circuit diagram of a pixel provided in a light emitting display according to a second embodiment of the present invention. In FIG. 7, a pixel 140 receives an initialization signal before receiving a data signal, and at least one of transistors provided in the pixel 140 can be used as a diode.

Referring to FIG. 7, each pixel 140 according to the second embodiment of the present invention includes a light emitting device OLED and a pixel circuit 144. The pixel circuit 144 is connected to the second data line DL and the scan line S (e.g., the scan line Sn and/or the scan line Sn-1) and is for controlling the light emitting device OLED to emit light.

The light emitting device OLED includes an anode electrode connected to the pixel circuit 144, and a cathode electrode connected to a second power line VSS. The second power line VSS is applied with a second voltage lower than that of a first voltage applied to a first power line VDD. For example, a ground voltage can be applied to the second power line VSS. The light emitting device OLED emits light corresponding to current supplied from the pixel circuit 144. For this, the light emitting device OLED includes fluorescent and/or phosphorescent organic materials.

The pixel circuit 144 includes a second transistor M2 which is connected to both the second data line DL and the $n^{th}$ scan line Sn; a third transistor M3 and a fourth transistor M4 which are connected between the second transistor M2 and a second initialization voltage line Vint2; a first transistor M1 and a fifth transistor M5 connected between the first power line VDD and the light emitting device OLED; and a storage capacitor Cst which is connected between a source terminal and a gate terminal of the first transistor M1. In FIG. 7, the first through fourth transistors M1 through M4 are of a PMOSFET and the fifth transistor M5 is of an n-type MOSFET (NMOSFET), but the present invention is not thereby limited and may vary as long as the fifth transistor M5 is different in type from the first through fourth transistors M1 through M4.

The first transistor M1 includes a source terminal connected to the first power line VDD, a drain terminal connected to a source terminal of the fifth transistor M5, and a gate terminal connected to a gate terminal of the third transistor M3. Further, the first transistor M1 supplies a current corresponding to a voltage charged in the storage capacitor Cst to the light emitting device OLED.

The fifth transistor M5 includes a drain terminal connected to the light emitting device OLED, and a gate terminal connected to the $(n-1)^{th}$ scan line Sn-1. Further, the fifth transistor M5 is turned on when the scan signal is not supplied to the $(n-1)^{th}$ scan line Sn-1, thereby supplying a current from the first transistor M1 to the light emitting device OLED.

The second transistor M2 includes a gate terminal connected to the $n^{th}$ scan line Sn, a source terminal connected to the second data line DL, and a drain terminal connected to a source terminal of the third transistor M3. Further, the second transistor M2 is turned on when the scan signal is transmitted to the $n^{th}$ scan line Sn, thereby transmitting the data signal from the data line DL to the third transistor M3.

The third transistor M3 includes a drain terminal connected to a source terminal of the fourth transistor M4. Further, the drain terminal and the gate terminal of the third transistor M3 are electrically connected to each other. Because the drain terminal and the gate terminal of the third transistor M3 are electrically connected to each other, the third transistor M3 functions as a diode.

The fourth transistor M4 includes a gate terminal connected to the $(n-1)^{th}$ scan line Sn-1, and a drain terminal connected to a second initialization voltage line Vint2. Further, the fourth transistor M4 is turned on when the scan signal is transmitted to the $(n-1)^{th}$ scan line Sn-1, thereby supplying a second initialization power from the second initialization voltage line Vint2 to the third transistor M3.

Figure 8:
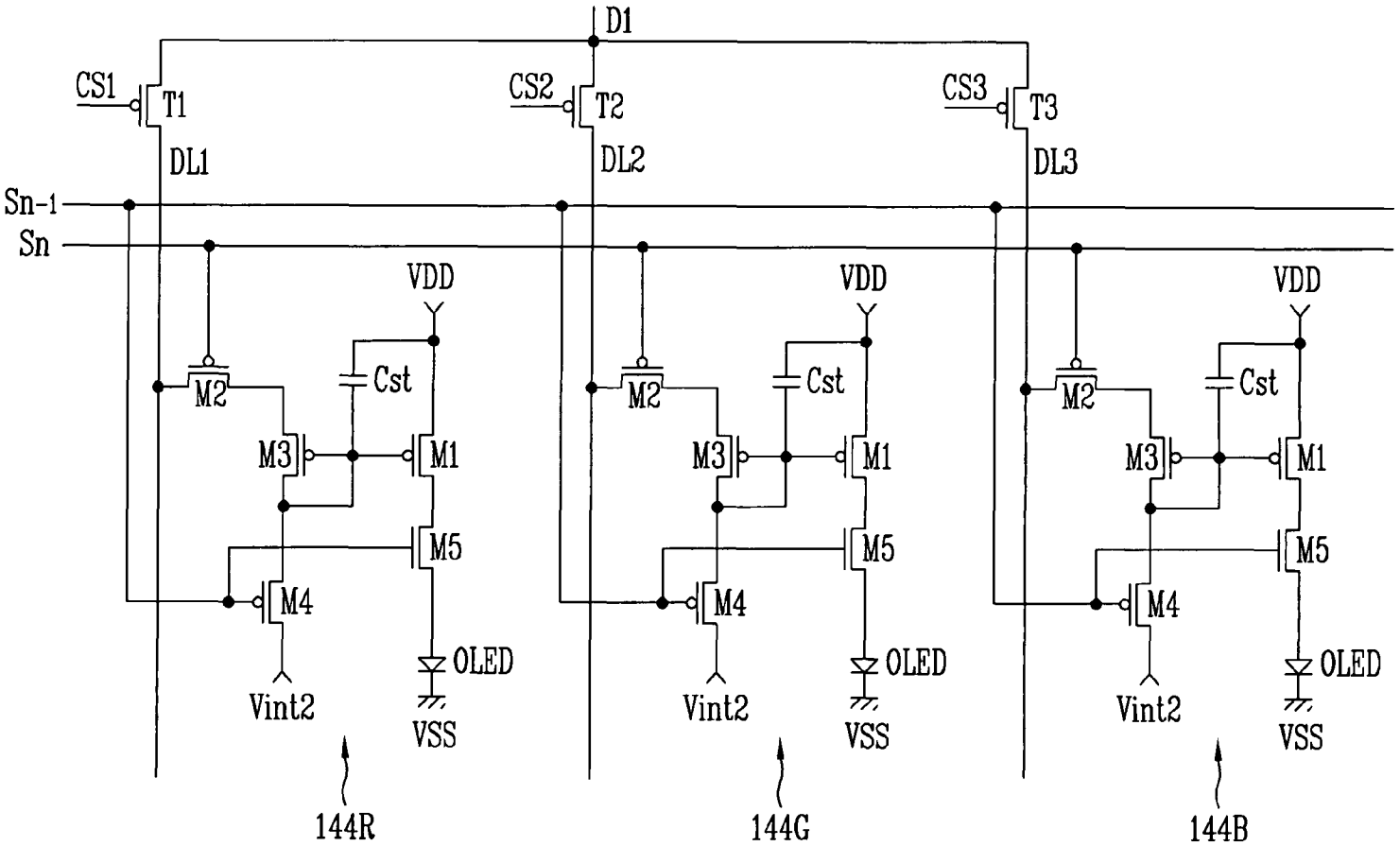
FIG. 8 is a circuit diagram showing connection between the demultiplexer of FIG. 3 and the pixel of FIG. 7.

FIG. 8 is a circuit diagram showing connection between the demultiplexer of FIG. 3 and the pixel of FIG. 7. For exemplary purposes, one demultiplexer 162 is shown to be connected with pixels of red (R), green (G) and blue (B); that is, i is equal to 3. Further, FIG. 9 illustrates waveforms of drive signals supplied to the demultiplexer and the pixel provided in the light emitting display according to the second embodiment of the present invention.

Figure 9:
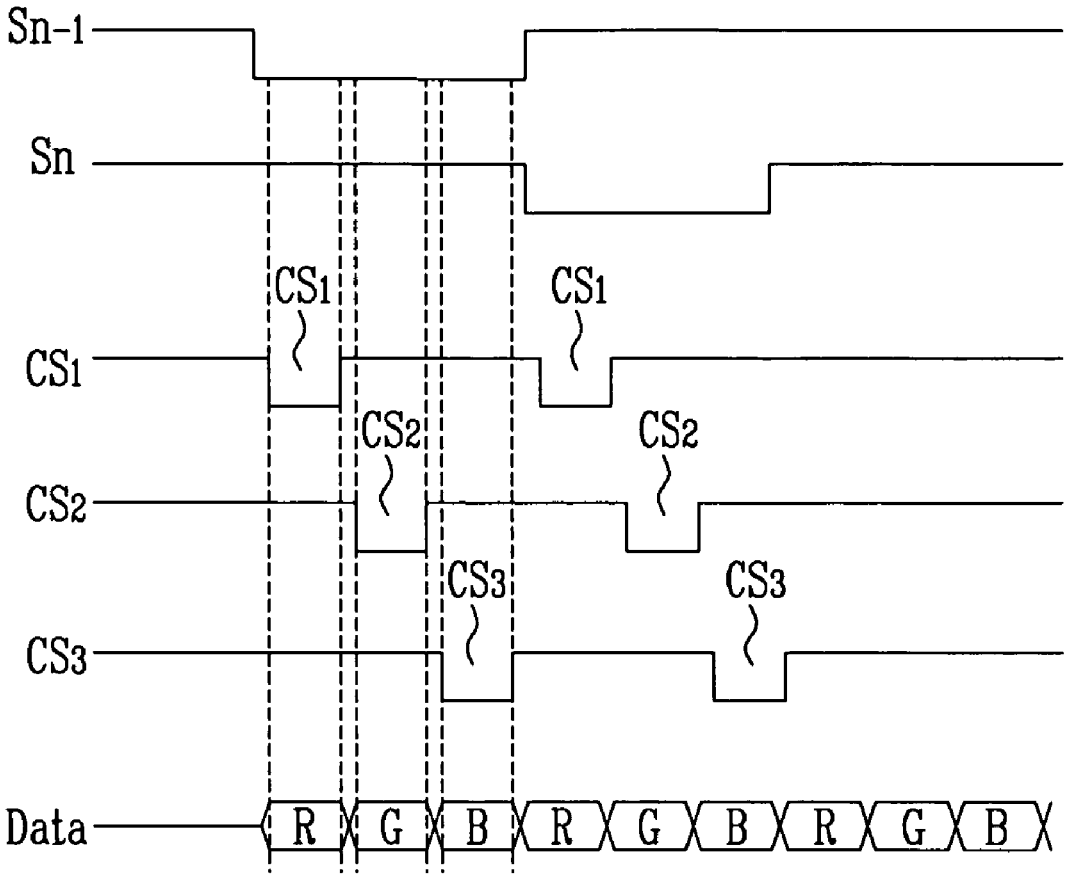
FIG. 9 illustrates waveforms of drive signals supplied to the demultiplexer and the pixel provided in the light emitting display according to the second embodiment of the present invention.

Referring to FIGS. 8 and 9, when the scan signal is transmitted to the $(n-1)^{th}$ scan line Sn-1, each fourth transistor M4 of the pixels 144R, 144G and 144B is turned on. Accordingly, as the fourth transistor M4 is turned on, one terminal of the storage capacitor Cst, the gate terminal of the first transistor M1, and the gate terminal of the third transistor M3 are connected to the second initialization voltage line Vint2. That is, when the fourth transistor M4 is turned on, the second initialization power Vint2 is supplied to and initializes the one terminal of the storage capacitor Cst, the gate terminal of the first transistor M1, and the gate terminal of the third transistor M3. In this embodiment, the second initialization power of the second initialization power line Vint2 is set to have a voltage lower than that of the voltage obtained by subtracting the threshold voltage of the third transistor M3 from the lowest voltage of the data signal supplied from a data driver (e.g., the data driver 120).

Then, the scan signal is transmitted to the $n^{th}$ scan line Sn. When the scan signal is transmitted to the $n^{th}$ scan line Sn, each second transistor M2 of the pixels 144R, 144G and 144B is turned on. After each second transistor M2 of the pixels 144R, 144G and 144B is turned on, the first switching device T1 is turned on by the first control signal CS1.

When the first switching device T1 is turned on, the data signal is supplied from the first data line D1 via the first switching device T1 to the source terminal of the third transistor M3 provided in the first pixel 144R. At this time, because the gate terminal of the third transistor M3 is initialized by the second initialization power of the second initialization power line Vint2, that is, has a voltage level lower than that of the source terminal, the third transistor M3 is turned on. When the third transistor M3 is turned on, the data signal is supplied to the gate terminal of the third transistor M3, that is, to the one terminal of the storage capacitor Cst. At this time, each storage capacitor Cst is charged with a voltage corresponding to the data signal. Further, the storage capacitor Cst is charged with a voltage corresponding to the threshold voltage of the first transistor M1 in addition to the voltage corresponding to the data signal.

Then, the first switching device T1 is turned off, and the second switching device T2 and the third switching device T3 are turned on in sequence, thereby supplying the data signal to the second pixel 144G and the third pixel 144B in sequence.

Thus, according to the second embodiment of the present invention, a demultiplexer (e.g., the demultiplexer 162) is employed for splitting and supplying the data signal from one first data line D1 to i second data lines DL. However, the second embodiment of the present invention may supply an undesired data signal to the pixels 144.

That is, while the first switching device T1 is turned on, the voltage corresponding to the data signal is charged in the storage capacitor Cst of the first pixel 144R. In the embodiment, while the first switching device T1 is turned on, each transistor M2 of the second and third pixels 144G and 144B is also turned on by the scan signal transmitted to the $n^{th}$ scan line Sn.

While the second transistor M2 of the second pixel 144G is turned on, each gate terminal of the first and third transistors M1 and M3 is electrically connected to the $2^{nd}$ second data line DL2. In this embodiment, the $2^{nd}$ second data line DL2 is connected with a parasitic capacitor or the like, thereby keeping the voltage of the data signal supplied during a previous period (previous field or previous frame). Thus, the voltage applied to the gate terminal of the first and third transistors M1 and M3 is changed into the voltage of the data signal transmitted during the previous period. That is, the voltage initialized by the second initialization power of the second initialization power line Vint2 is changed into the voltage of the data signal transmitted during the previous period.

Then, the second switching device T2 is turned on by the second control signal CS2. When the second switching device T2 is turned on, the data signal is transmitted from the $1^{st}$ first data line D1 to the $2^{nd}$ second data line DL2. Then, the data signal is transmitted from the $2^{nd}$ second data line DL2 to the source terminal of the third transistor M3 via the second transistor M2 of the second pixel 144G. In this embodiment, the source terminal of the third transistor M3 is applied with the voltage corresponding to the current data signal, and the gate terminal is applied with the voltage corresponding to the previous data signal. In this case, the third transistor M3 is turned on only when the voltage of the current data signal is higher than the voltage of the previous data signal and the threshold voltage of the third transistor M3, and is turned off otherwise.

As such, according to the second embodiment of the present invention, while the demultiplexer (e.g., the demultiplexer 162) operates, the voltage applied to the gate terminal of each third transistor M3 provided in the second and third pixels 144G and 144B is changed, so that the data signal may not have a desired voltage and thus it may be difficult to properly display a desired image. To enhance the first and/or second exemplary embodiments, the present invention provides a light emitting display as shown in FIG. 10.

Figure 10:
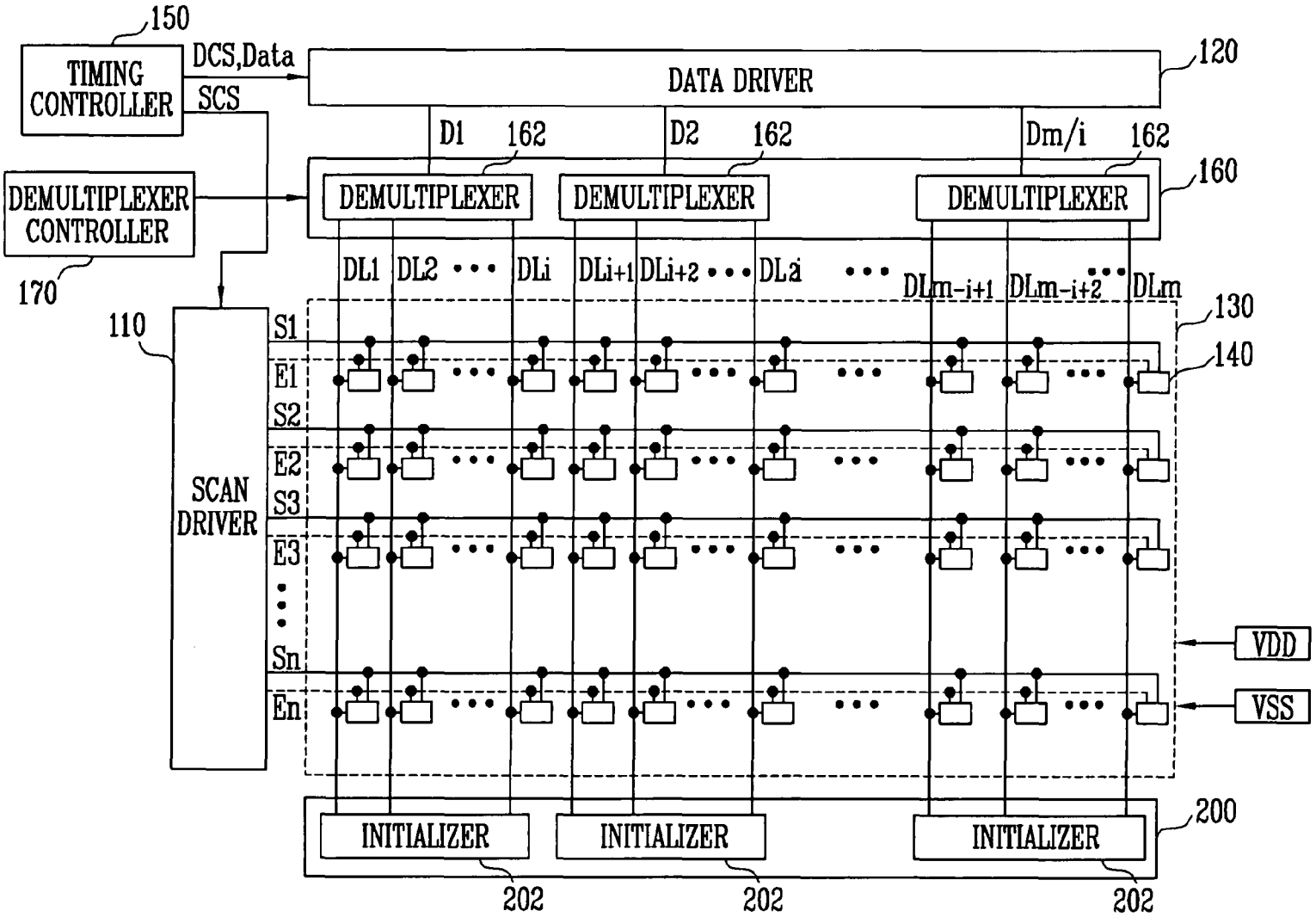
FIG. 10 is a plan view of a light emitting display according to a third embodiment of the present invention.

FIG. 10 is a plan view of a light emitting display according to a third embodiment of the present invention. Hereinbelow, like numerals refer to like elements.

Referring to FIG. 10, a light emitting display according to the third embodiment of the present invention includes a scan driver 110, a data driver 120, an image displaying part 130, a timing controller 150, a demultiplexing block 160, a demultiplexer controller 170, and an initialization block 200.

The initialization block 200 includes a plurality of initializers 202 connected to i second data lines DL. The initializer 202 supplies a first initialization power to each second data line DL before transmitting the data signal to each second data line DL.

Figure 11:
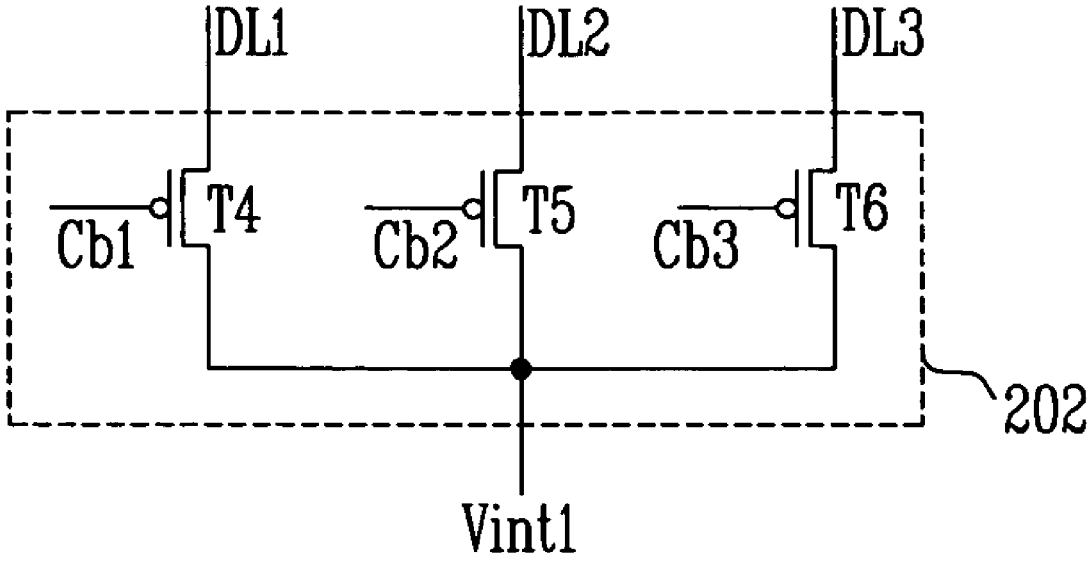
FIG. 11 is a circuit diagram of an initializer provided in the light emitting display according to the third embodiment of the present invention.

As exemplarily shown in FIG. 11, the initialization block 200 includes i initialization switching devices T4, T5 and T6, where i=3. The initialization switching devices T4, T5 and T6 are commonly connected to a first initialization power line Vint1, and connected to the respective second data lines DL1, DL2 and DL3. Further, in one embodiment, the initialization switching devices T4, T5 and T6 are turned on at the same time, but turned off at different times with respect to one another, thereby supplying the first initialization power Vint1 to the respective second data lines DL1, DL2, and DL3.

Figure 12:
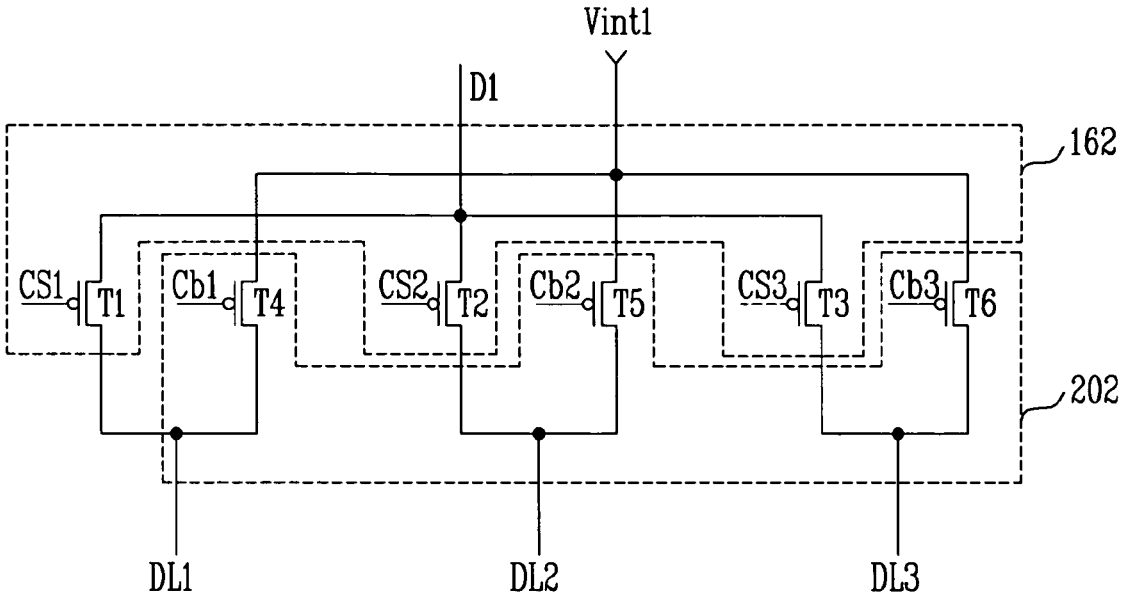
FIG. 12 is a circuit diagram of connection between the initializer and a demultiplexer provided in the light emitting display according to the third embodiment of the present invention.

According to the third embodiment of the present invention, as shown in FIG. 12, the initialization switching devices T4, T5 and T6 provided in the initializer 202 can be disposed adjacent to data switching devices T1, T2 and T3, respectively. In this embodiment, the same operation is performed regardless of whether the initialization switching devices T4, T5 and T6 are adjacent to or a distance away from the data switching devices T1, T2 and T3, respectively. In this embodiment, for exemplary purposes, the initialization switching devices T4, T5 and T6 is shown to be disposed adjacent to data switching devices T1, T2 and T3, respectively. Further, in a case where a demultiplexer 162 and the initializer 202 are arranged as shown in FIG. 12, the demultiplexer 162 and initializer 202 can be hereinbelow collectively referred to as a demultiplexing circuit.

The first switching device T1 is provided between the $1^{st}$ first data line D1 and the $1^{st}$ second data line DL1, and supplies the data signal from the first data line D1 to the $1^{st}$ second data line DL1. Further, referring also to FIG. 14, the first switching device T1 is turned on by a first control signal CS1 supplied from the demultiplexer controller 170 (refer to FIG. 14).

The second switching device T2 is provided between the $1^{st}$ first data line D1 and the $2^{nd}$ second data line DL2, and supplies the data signal from the $1^{st}$ first data line D1 to the $2^{nd}$ second data line DL2. Further, the second switching device T2 is turned on by a second control signal CS2 supplied from the demultiplexer controller 170 (refer to FIG. 14).

The third switching device T3 is provided between the $1^{st}$ first data line D1 and the $3^{rd}$ second data line DL3, and supplies the data signal from the $1^{st}$ first data line D1 to the $3^{rd}$ second data line DL3. Further, the first switching device T1 is turned on by a third control signal CS3 supplied from the demultiplexer controller 170 (refer to FIG. 14).

The fourth switching device T4 is provided between the first initialization power line Vint1 and the $1^{st}$ second data line DL1, and supplies the first initialization power of the first initialization power line Vint1 to the $1^{st}$ second data line DL1. In this embodiment, the first initialization power Vint1 has a voltage lower than the lowest voltage applicable to an image displaying part 130. For example, in a case where the lowest voltage applicable to the image displaying part 130 is 2V, the first initialization power Vint1 is set to have a voltage lower than 2V. Substantially, the first initialization power Vint1 is set to have a voltage lower than that obtained by subtracting the threshold voltage of a transistor provided in a pixel 140 from the lowest voltage of the data signal applicable to the image displaying part 130. Thus, the fourth switching device T4 is turned on by the first initialization control signal Cb1 supplied from the demultiplexer controller 170 (refer to FIG. 14).

The fifth switching device T5 is provided between the first initialization power line Vint1 and the $2^{nd}$ second data line DL2, and supplies the first initialization power of the first initialization in power line Vint1 to the $2^{nd}$ second data line DL2. Further, the fifth switching device T5 is turned on by the second initialization control signal Cb2 supplied from the demultiplexer controller 170 (refer to FIG. 14).

The sixth switching device T6 is provided between the first initialization power line Vint1 and the 3rd second data line DL3, and supplies the first initialization power of the first initialization power line Vint1 to the $3^{rd}$ second data line DL3. Further, the sixth switching device T6 is turned on by the third initialization control signal Cb3 supplied from the demultiplexer controller 170 (refer to FIG. 14).

Figure 14:
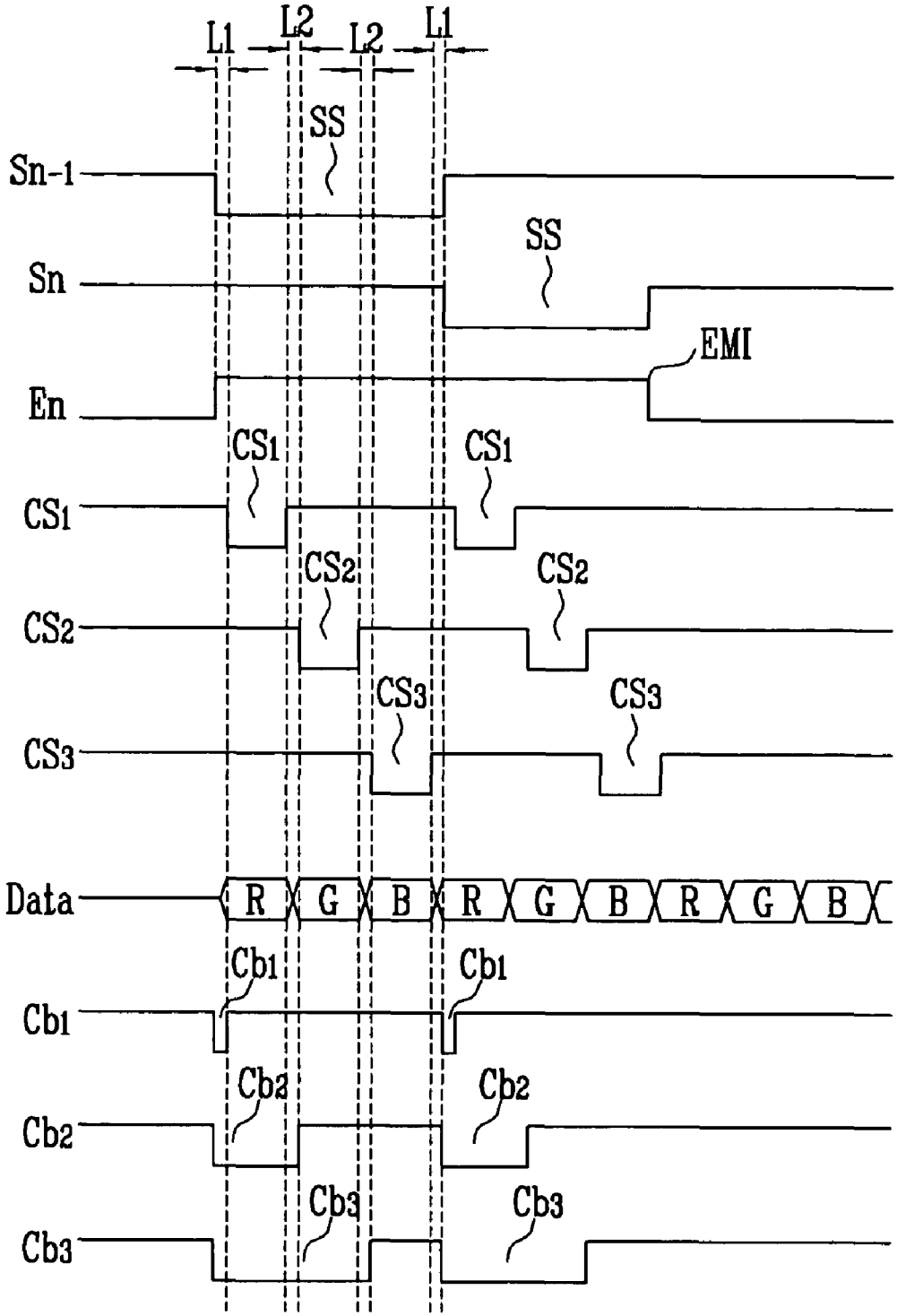
FIG. 14 illustrates waveforms of drive signals supplied to the demultiplexer and the pixel provided in the light emitting display according to the third embodiment of the present invention.

In this embodiment, the demultiplexer controller 170 outputs the first, second and third control signals CS1, CS2 and CS3 in sequence when the scan signal is transmitted to the scan line S (e.g., the scan line Sn and the scan line Sn-1). In FIG. 14, the respective control signals CS1 through CS3 are transmitted leaving a time difference of a second period L2 therebetween. Further, the first control signal CS1 is transmitted as late as a first period L1 after the scan signal SS of the scan line S (e.g., the scan line Sn-1) is transmitted. Also, the third control signal CS3 rises as early as the first period L1 before the scan signal SS of the scan lines (e.g., the scan line Sn-1) rises.

The demultiplexer controller 170 outputs a first initialization control signal Cb1, a second initialization control signal Cb2, and a third initialization control signal Cb3 when the scan signal SS is transmitted to synchronize with the scan signal SS. In FIG. 14, the first initialization control signal Cb1 rises before the first control signal CS1 is supplied, so that the first initialization control signal Cb1 and the fist control signal CS1 are not overlapped with each other. The second initialization control signal Cb2 rises before the second control signal CS2 is transmitted, so that the second initialization control signal Cb2 and the second control signal CS2 are not overlapped with each other. The third initialization control signal Cb3 rises before the third control signal CS3 is transmitted. Because of this, the fourth through sixth switching devices T4, T5 and T6 are turned off before the first through third switching devices T1, T2 and T3 connected to the same data line as the fourth through sixth switching devices T4, T5 and T6 connected are turned on, respectively.

In FIGS. 11 and 12, the switching devices T1 through T6 are illustrated as p-type switching devices, but the present invention is not limited to the p-type switching devices. Substantially, the switching devices T1 through T6 are set to have the same type as that of the transistors provided in the pixels 140 and connected to the second data line DL. For example, in a case where the transistors connected to the second data line DL are of the p-type, the switching devices T1 through T6 are also formed as p-type switching devices. On the other hand, in a case where the transistors connected to the second data line DL are of an n-type, the switching devices T1 through T6 are also formed as the n-type switching devices.

Figure 13:
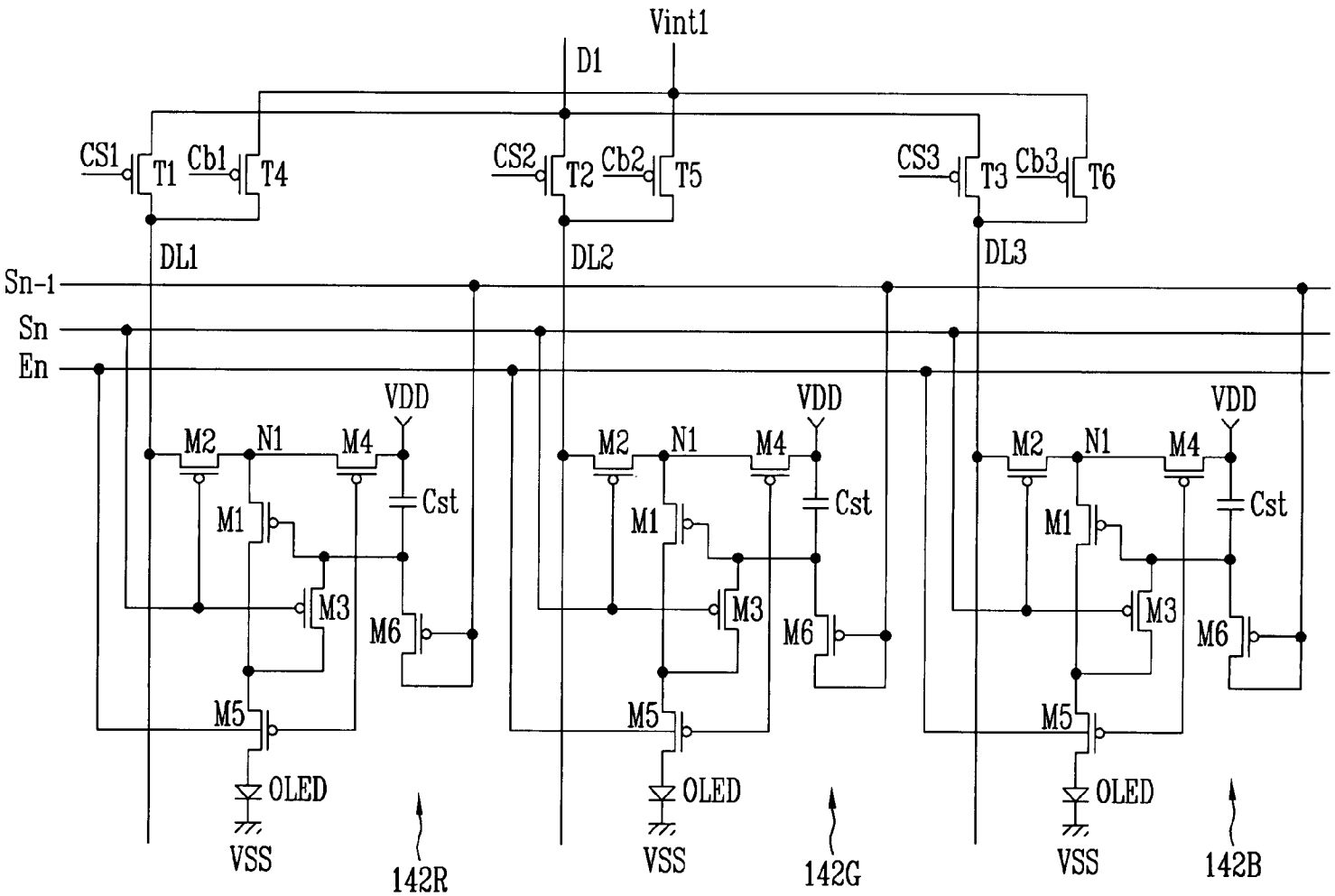
FIG. 13 is a circuit diagram of connection among the initializer, the demultiplexer and a pixel provided in the light emitting display according to the third embodiment of the present invention.

FIG. 13 is a circuit diagram of connection among the initializer and the demultiplexer of FIG. 12 and a pixel of FIG. 4. For exemplary purposes, one demultiplexer is shown to be connected with pixels of red (R), green (G) and blue (B); that is, i is equal to 3. Also, FIG. 14 illustrates waveforms of drive signals supplied to the scan line, the data line, and demultiplexer provided in the light emitting display according to the third embodiment of the present invention.

Referring to FIGS. 13 and 14, when the scan signal SS is transmitted to the $(n-1)^{th}$ scan line Sn-1, each sixth transistor M6 of the pixels 142R, 142G and 142B is turned on. Accordingly, as the sixth transistor M6 is turned on, the storage capacitor Cst and the gate terminal of the first transistor M1 are connected to the $(n-1)^{th}$ scan line Sn-1. That is, when the sixth transistor M6 is turned on, the scan signal SS is supplied to each storage capacitor Cst and each gate terminal of the first transistor M1, thereby initializing each storage capacitor Cst and each gate terminal of the first transistor M1.

Then, the scan signal SS is transmitted to the $n^{th}$ scan line Sn. When the scan signal SS is transmitted to the $n^{th}$ scan line Sn, each second transistor M2 and each third transistor M3 of the pixels 142R, 142G and 142B are turned on. Further, the first through third initialization control signals Cb1, Cb2 and Cb3 are transmitted to synchronize with the scan signal SS transmitted to the $n^{th}$ scan line Sn. Accordingly, as the first through third initialization control signals Cb1, Cb2 and Cb3 are transmitted, the fourth, fifth and sixth switching devices T4, T5 and T6 are turned on.

When the fourth; fifth and sixth switching devices T4, T5 and T6 are turned on, the voltage of the first initialization power of the first initialization power line Vint1 is applied to the $1^{st}$ through $3^{rd}$ second data lines DL1, DL2 and DL3. Here, the voltage of the first initialization power Vint1 is applied from the $1^{st}$ through $3^{rd}$ second data lines DL1, DL2 and DL3 to each first node N1 of the pixels 142R, 142G and 142B. In this embodiment, because the gate terminal of each first transistor M1 of the pixels 142R, 142G and 142B is initialized by the scan signal SS transmitted to the $(n-1)^{th}$ scan line Sn-1, the voltage corresponding to the scan signal SS is kept.

When the first initialization power of the first initialization power line Vint1 is supplied to the first node N1, the first transistor M1 is turned on or off. Substantially, the voltage of the initialization power of the power line Vint1 determines whether the first transistor M1 is turned on or off. In this embodiment, the initialization power of the power line Vint1 is set to have a voltage lower than that obtained by subtracting the threshold voltage of the transistor provided in the pixel 140 from the lowest voltage of the data signal applicable to the image displaying part 130.

For example, when the first transistor M1 is turned on, the voltage applied to the gate terminal of the first transistor M1 is changed into the voltage of the initialization power of the power line Vint1. Further, when the first transistor M1 is turned off, the voltage applied to the gate terminal of the first transistor M1 is kept at the voltage of the scan signal SS.

Then, the first control signal CS1 is transmitted, thereby turning on the first switching device T1. In this embodiment, the first initialization control signal Cb1 is interrupted before transmitting the first control signal CS1. On the other hand, the second and third initialization control signals Cb2 and Cb3 continue to overlap with the first control signal CS1.

The first control signal CS1 is transmitted and thus the first switching device T1 is turned on. When the first switching device T1 is turned on, the data signal is transmitted from the $1^{st}$ first data line D1 to the first node N1 of the first pixel 142R via the second transistor M2. When the voltage corresponding to the data signal is applied to the first node N1, the first transistor M1 is turned on. In other words, the voltage applied to the gate terminal of the first transistor M1 is set to the voltage of the initialization power of the power line Vint1 or the voltage of the scan signal, so that the first transistor M1 is turned on when the data signal is transmitted to the first node N1. When the first transistor M1 is turned on, the data signal is transmitted from the first node N1 to one terminal of the storage capacitor Cst via the first and third transistors M1 and M3. At this time, the storage capacitor Cst is charged with the voltage corresponding to the data signal.

Then, the first switching device T1 is turned off, and the second switching device T2 is turned on by the second control signal CS2. In this embodiment, the second initialization control signal Cb2 is interrupted before transmitting the second control signal CS2. On the other hand, the third initialization control signal Cb3 continues to overlap with the second control signal CS2.

The second control signal CS2 is transmitted and thus the second switching device T2 is turned on. When the second switching device T2 is turned on, the data signal is transmitted from the $1^{st}$ first data line D1 to the first node N1 of the second pixel 142G via the second transistor M2. When the voltage corresponding to the data signal is applied to the first node N1, the first transistor M1 is turned on. In other words, the voltage applied to the gate terminal of the first transistor M1 is set to the voltage of the initialization power of the power line Vint1 or the voltage of the scan signal, so that the first transistor M1 is turned on when the data signal is transmitted to the first node N1. When the first transistor M1 is turned on, the data signal is transmitted from the first node N1 to one terminal of the storage capacitor Cst via the first and third transistors M1 and M3. At this time, the storage capacitor Cst is charged with the voltage corresponding to the data signal.

Then, the second switching device T2 is turned off, and the third switching device T3 is turned on by the third control signal CS3. In this embodiment, the third initialization control signal Cb3 is interrupted before transmitting the third control signal CS3.

The third control signal CS3 is transmitted and thus the third switching device T3 is turned on. When the third switching device T3 is turned on, the data signal is transmitted from the $1^{st}$ first data line D1 to the first node N1 of the third pixel 142B via the second transistor M2. When the voltage corresponding to the data signal is applied to the first node N1, the first transistor M1 is turned on. In other words, the voltage applied to the gate terminal of the first transistor M1 is set to the voltage of the initialization power of the power line Vint1 or the voltage of the scan signal, so that the first transistor M1 is turned on when the data signal is transmitted to the first node N1. When the first transistor M1 is turned on, the data signal is transmitted from the first node N1 to one terminal of the storage capacitor Cst via the first and third transistors M1 and M3. At this time, the storage capacitor Cst is charged with the voltage corresponding to the data signal.

As described above, according to the present invention, the demultiplexer 162 is employed in transmitting the data signal from one first data line D1 to i second data lines. Further, the initialization switching devices are additionally provided corresponding to the data switching devices, and the first initialization power of the first initialization power line Vint1 is supplied until the data signal is transmitted to each second data line DL, thereby a desired image is displayed.

Figure 15:
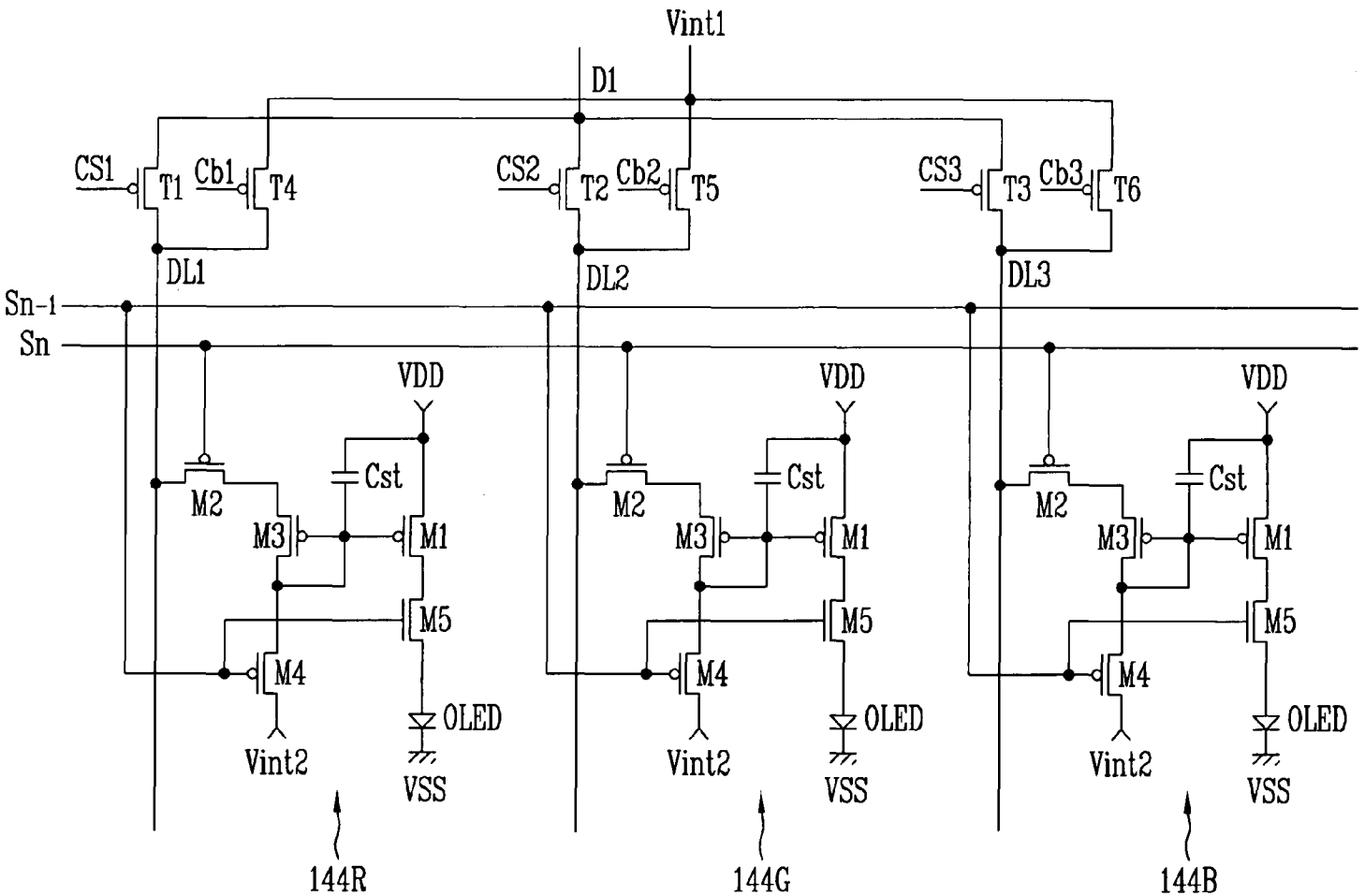
FIG. 15 is a circuit diagram of connection among a initializer, a demultiplexer and a pixel provided in a light emitting display according to a fourth embodiment of the present invention.

FIG. 15 is a circuit diagram of connection among the initializer and the demultiplexer of FIG. 12 and the pixel of FIG. 7. For exemplary purposes, one demultiplexer is shown to be connected with pixels of red (R), green (G) and blue (B).

Referring to FIGS. 14 and 15, when the scan signal SS is transmitted to the $(n-1)^{th}$ scan line Sn-1, each fourth transistor M4 of the pixels 144R, 144G and 144B is turned on. Accordingly, as the fourth transistor M4 is turned on, the one terminal of the storage capacitor Cst and each gate terminal of the first and third transistors M1 and M3 are connected to the second initialization power of the second initialization power line Vint2. That is, when the fourth transistor M4 is turned on, the second initialization power of the second initialization power line Vint2 is supplied to the one terminal of the storage capacitor Cst and each gate terminal of the first and third transistors M1 and M3, thereby initializing the one terminal of the storage capacitor Cst and each gate terminal of the first and third transistors M1 and M3. In this embodiment, the second initialization power of the second initialization power line Vint2 is set to have a voltage lower than that obtained by subtracting the threshold voltage of the transistor M3 from the lowest voltage of the data signal supplied from the data driver 120. Further, the second initialization power of the second initialization power line Vint2 is set to have a voltage equal to or different from that of the first initialization power of the first initialization power line Vint1.

Then, the scan signal SS is transmitted to the $n^{th}$ scan line Sn. When the scan signal is transmitted to the $n^{th}$ scan line Sn, each second transistor M2 of the pixels 144R, 144G and 144B is turned on. Further, the first through third initialization control signals Cb1, Cb2 and Cb3 are transmitted to synchronize with the scan signal SS transmitted to the $n^{th}$ scan line Sn. According as the first through third initialization control signals Cb1, Cb2 and Cb3 are transmitted, the fourth, fifth and sixth switching devices T4, T5 and T6 are turned on.

When the fourth, fifth and sixth switching devices T4, T5 and T6 are turned on, the voltage of the first initialization power of the first initialization power line Vint1 is applied to the $1^{st}$ through $3^{rd}$ second data lines DL1, DL2 and DL3. Here, the voltage of the first initialization power Vint1 is applied from the $1^{st}$ through $3^{rd}$ second data lines DL1, DL2 and DL3 to each source terminal of the third transistor M3 provided in the pixels 144R, 144G and 144B. In this embodiment, because the gate terminal of the third transistor M3 is initialized by the second initialization power of the second initialization power line Vint2, the voltage of the second initialization power of the second initialization power line Vint2 is kept.

When the first initialization power of the first initialization power line Vint1 is supplied to the source terminal of the third transistor M3, the third transistor M3 is either turned on or off. Substantially, the voltage of the initialization power of the first initialization power line Vint1 determines whether the third transistor M3 is turned on or off. In this embodiment, when the third transistor M3 is turned on, the voltage applied to the gate terminal of the third transistor M3 is changed into the voltage of the first initialization power of the first initialization power line Vint1. Further, when the third transistor M3 is turned off, the voltage applied to the gate terminal of the third transistor M3 is kept having the voltage of the second initialization power of the second initialization power line Vint2.

Then, the first control signal CS1 is transmitted, thereby turning on the first switching device T1. In this embodiment, the first initialization control signal Cb1 is interrupted before transmitting the first control signal CS1. On the other hand, the second and third initialization control signals Cb2 and Cb3 continue to overlap with the first control signal CS1.

When the first switching device T1 is turned on, the data signal is transmitted from the $1^{st}$ first data line D1 to the source terminal of the third transistor M3 provided in the first pixel 144R via the first switching device T1. At this time, because the gate terminal of the third transistor M3 is initialized by the first or second initialization power of the first or second initialization power line Vint1 or Vint2, the third transistor M3 is turned on. When the third transistor M3 is turned on, the data signal is transmitted to the gate terminal of the third transistor M3, i.e., the one terminal of the storage capacitor Cst. At the same time, the storage capacitor Cst is charged with the voltage corresponding to the data signal. Further, the storage capacitor Cst is charged with the voltage corresponding to the threshold voltage of the first transistor M1 in addition to the voltage corresponding to the data signal.

Then, the first switching device T1 is turned off, and the second switching device T2 is turned on by the second control signal CS2. In this embodiment, the second initialization control signal Cb2 is interrupted before transmitting the second control signal CS2. On the other hand, the third initialization control signal Cb3 continues to overlap with the second control signal CS2.

When the second switching device T2 is turned on, the data signal is transmitted from the $1^{st}$ first data line D1 to the source terminal of the third transistor M3 provided in the second pixel 144G via the second switching device T2. At this time, because the gate terminal of the third transistor M3 is initialized by the first or second initialization power of the first or second initialization power line Vint1 or Vint2, the third transistor M3 is turned on. When the third transistor M3 is turned on, the data signal is transmitted to the gate terminal of the third transistor M3, that is, the one terminal of the storage capacitor Cst. At this time, the storage capacitor Cst is charged with the voltage corresponding to the data signal. Further, the storage capacitor Cst is charged with the voltage corresponding to the threshold voltage of the first transistor M1 in addition to the voltage corresponding to the data signal.

Then, the second switching device T2 is turned off, and the third switching device T3 is turned on by the third control signal CS3. In this embodiment, the third initialization control signal Cb3 is interrupted before transmitting the third control signal CS3.

When the third switching device T3 is turned on, the data signal is transmitted from the $1^{st}$ first data line D1 to the source terminal of the third transistor M3 provided in the third pixel 144B via the third switching device T3. At this time, because the gate terminal of the third transistor M3 is initialized by the first or second initialization power of the first or second initialization power line Vint1 or Vint2, the third transistor M3 is turned on. When the third transistor M3 is turned on, the data signal is transmitted to the gate terminal of the third transistor M3, that is, the one terminal of the storage capacitor Cst. At this time, the storage capacitor Cst is charged with the voltage corresponding to the data signal. Further, the storage capacitor Cst is charged with the voltage corresponding to the threshold voltage of the first transistor M1 in addition to the voltage corresponding to the data signal.

As described above, according to the present invention, the demultiplexer 162 is employed in transmitting the data signal from one first data line D1 to i second data lines. Further, the initialization switching devices are additionally provided corresponding to the data switching devices, and the first initialization power of the first initialization power line Vint1 is supplied until the data signal is transmitted to each second data line DL, thereby a desired image is stably displayed.

In addition, as shown in FIG. 14, while the scan signal SS is supplied, the initialization switching devices T4, T5 and T6 are set to have different turned-on periods from each other. Among the initialization switching devices T4, T5, and T6, the initialization switching device T4, T5, and T6 having the shortest turned-on period while the scan signal is supplied should have the widest channel width.

Figure 16:
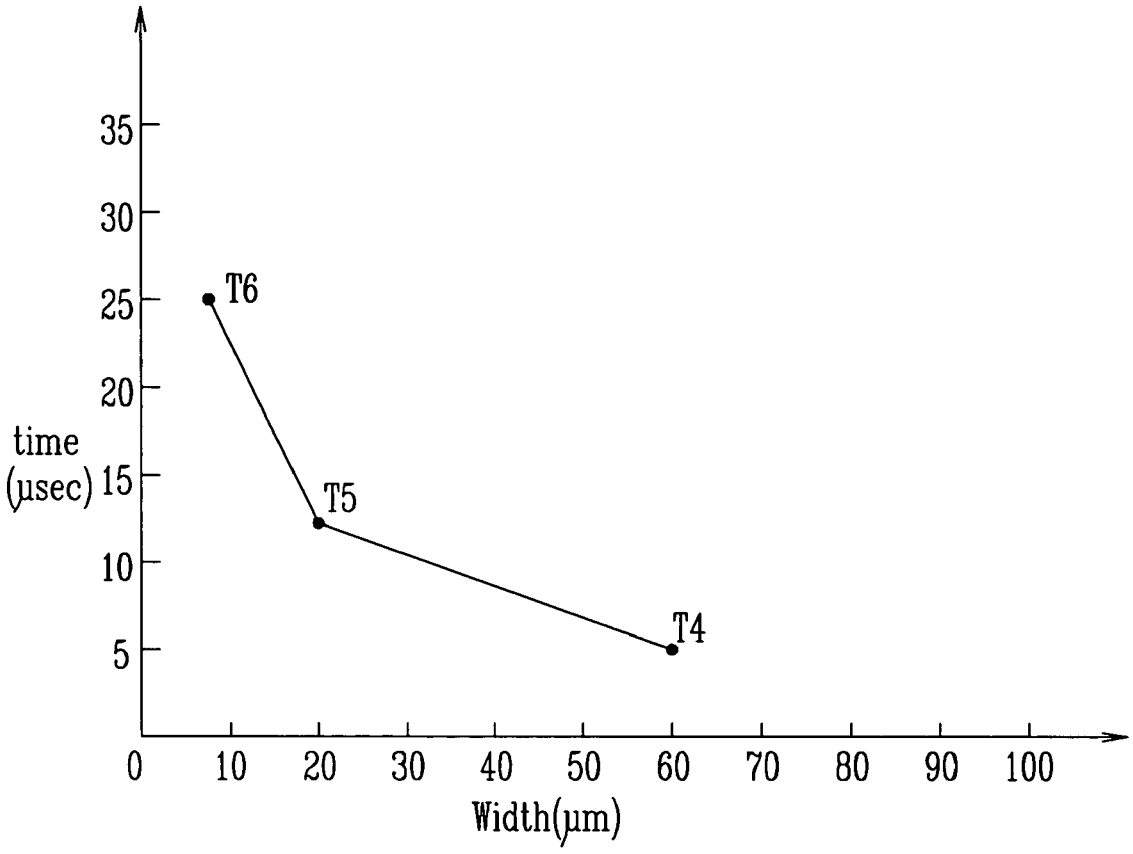
FIG. 16 is a graph showing a channel width corresponding to a turn-on period of an initialization switching device.

FIG. 16 is a graph showing a channel width corresponding to a turned-on period of an initialization switching device. In FIG. 16, for exemplary purposes, the fourth initialization switching device T4 is shown to have the shortest turned-on period, and at the same time, the sixth initialization switching device T6 is shown to have the longest turned-on period.

Referring to FIG. 16, in one embodiment of the invention, the fourth switching device T4 having the shortest turned-on period has a channel width of about 60 μm to supply a first initialization power (or voltage) of the first initialization power line Vint1 within a desired time of about 5 μs. Further, in one embodiment, the sixth switching device T6 having the longest turned-on period has a channel width of about 10 μm to supply the first initialization power (or voltage) of the first initialization power line Vint1 within a desired time of about 25 μs. In addition, in one embodiment, the fifth switching device T5 having an intermediate turned-on period between those of the fourth and sixth switching devices T4 and T6 has a channel width of about 20,u m to supply the first initialization voltage of the first initialization power line Vint1 within a desired time of about 13 μs.

As shown in FIG. 16, the initialization switching devices T4 through T6 should have enough of a channel width to sufficiently supply the first initialization voltage of the first initialization power line Vint1 to the second data line DL, thereby securing a stable operation. In one embodiment, to make all initialization switching devices T4 through T6 have the same channel width, the fifth and sixth initialization switching devices T5 and T6 are adjusted to have the same channel width as the fourth switching device T4.

However, when all initialization switching devices T4 through T6 have the same channel width, a space occupied by the initialization switching devices T4 through T6 is increased, so that it is difficult to freely design the circuit thereof. Additionally, as the space occupied by the initialization switching devices T4 through T6 is increased, a space to be occupied by peripheral circuits is decreased, thereby deteriorating reliability. Therefore, according to an embodiment of the present invention, the sizes (i.e., channel widths) of the initialization switching devices are differently set corresponding to the turned-on periods of the initialization switching devices T4 through T6.

Figure 17:
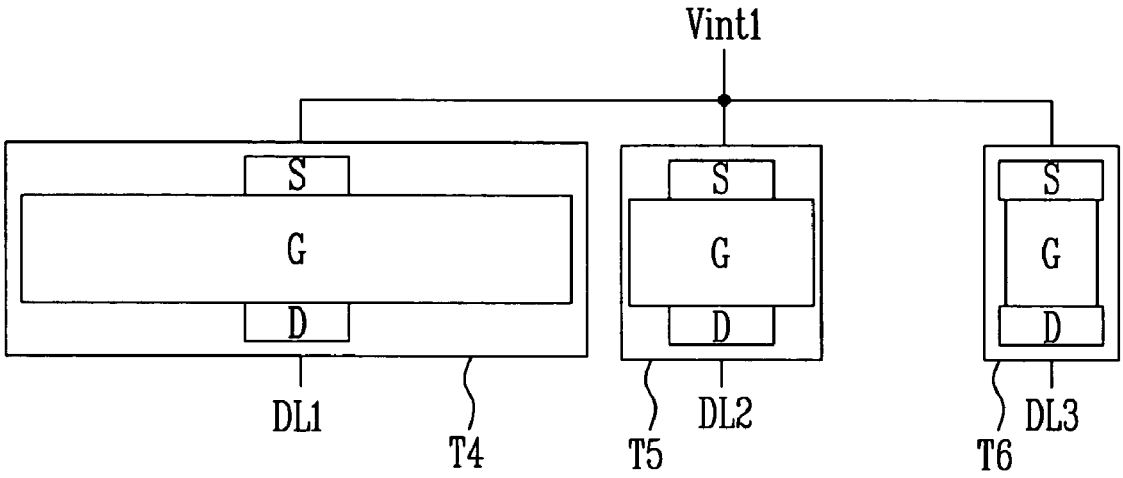
FIG. 17 illustrates the size of the initialization switching devices, which is set in inverse proportion to the turn-on period.

For example, as shown in FIG. 17, the fourth switching device T4 has the largest size, which has the shortest turned-on period while the scan signal is supplied. Further, the sixth switching device T6 has the smallest size, which has the longest turned-on period while the scan signal is supplied. Thus, the sizes of the initialization switching devices T4 through T6 are differently set corresponding to the turned-on periods of the initialization switching devices T4 through T6, so that the area occupied by the initialization switching devices T5 and T6 is decreased, thereby securing freedom in a circuit design. In addition, as the initialization switching devices to be turned-on later are decreased in size, voltage (or current) supplied from the initialization switching device is lowered, thereby reducing power consumption.

Figure 18:
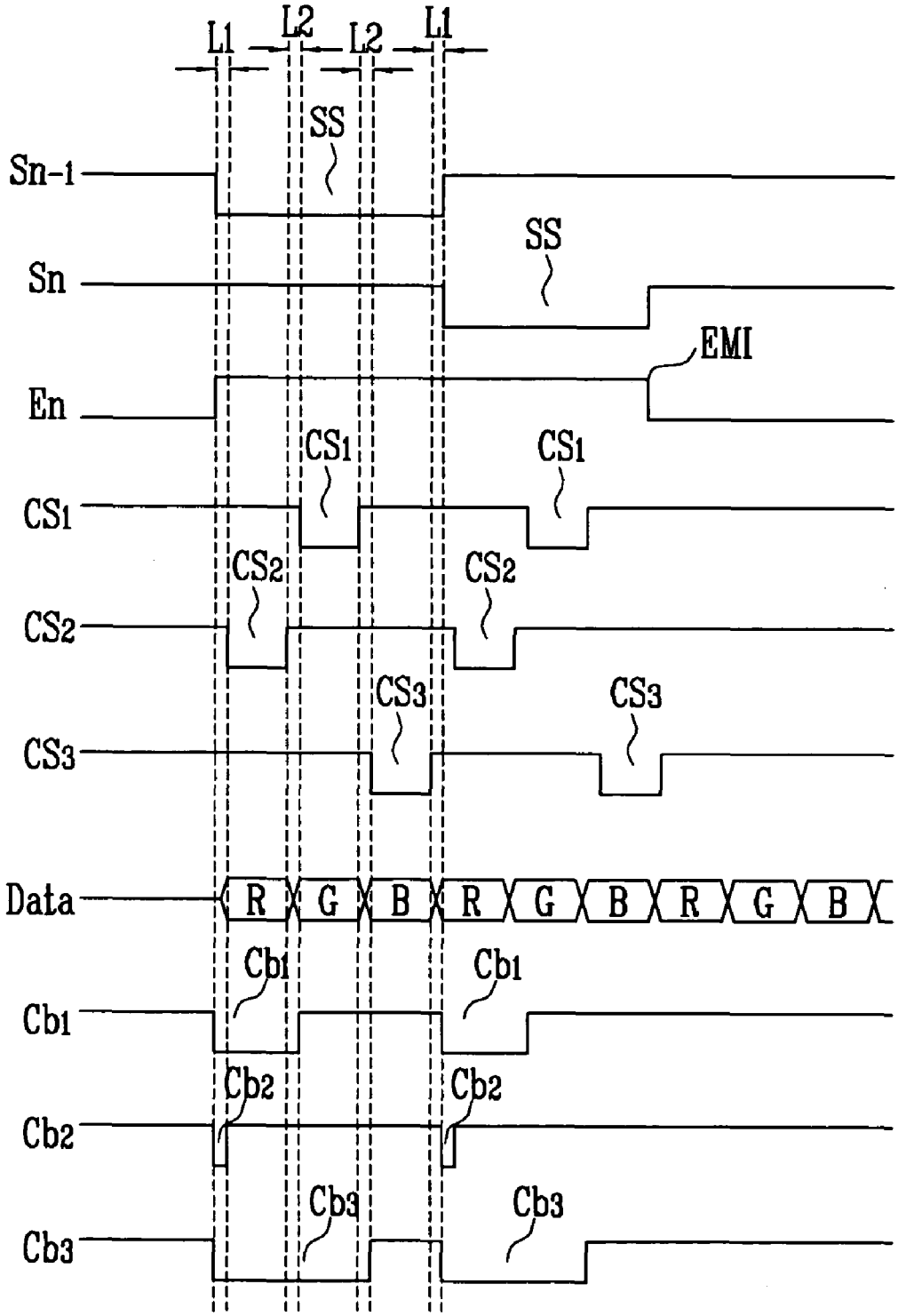
FIG. 18 illustrates waveforms of drive signals supplied to the demultiplexer, the initializer and the pixel provided in the light emitting display according to the third and fourth embodiments of the present invention.

Experimentally, referring to FIG. 18, while the scan signal SS is supplied, the current supplied to the pixel 140 that is subsequently receiving the data signal is higher than the current supplied to the pixel 140 that is previously receiving the data signal. Thus, a supplying order of the first through third control signals CS1 through CS3 is set as illustrated in FIG. 18 in consideration of an emission efficiency of the light emitting device OLED on the assumption that each demultiplexer 162 is connected with a red (R) pixel, a green (G) pixel and a blue (B) pixel.

In more detail, the storage capacitor Cst of the pixel 140 previously receiving the data signal while the scan signal SS is supplied is charged with the voltage corresponding to the data signal. However, the voltage corresponding to the data signal is not sufficiently supplied to the storage capacitor Cst of the pixel 140 subsequently receiving the data signal while the scan signal SS is supplied, so that a relatively high voltage is supplied thereto. That is, even though the data signals corresponding to the same gradation are supplied, the pixel 140, which subsequently receives the data signal, receives a higher current for its light emitting device OLED.

In addition, the emission efficiency of the light emitting device OLED is set in order of the green light emitting device OLED, the red light emitting device OLED, and the blue light emitting device OLED. Therefore, according to an embodiment of the present invention, as shown in FIG. 18, the second control signal CS2 is supplied first, so that the green data signal is first transmitted to the green light emitting device OLED having the relatively high emission efficiency. Further, the third control signal CS3 is supplied last, so that the data signal is transmitted last to the blue light emitting device OLED having the relatively low emission efficiency. Accordingly, when the data signals corresponding to the same gradation are supplied, the lowest current is supplied to the green light emitting device OLED having the relatively high emission efficiency, but the highest current is supplied to the blue light emitting device OLED having the relatively low emission efficiency. That is, according to an embodiment of the present invention, the supplying order of the first through third control signals CS1 through CS3 is set in consideration of the emission efficiency of the light emitting device OLED, thereby displaying an image with improved white balance.

As described above, the present invention provides a demultiplexing circuit, a light emitting display using the same, and a driving method thereof, in which a demultiplexer is employed for supplying a data signal from one output line to i data lines, thereby reducing production cost. Further, each demultiplexer is additionally provided with i initialization transistors, and the initialization transistor is kept turned on until data transistor connected to the same data line as the initialization transistor connected is turned on, thereby supplying a desired data signal to the pixels. Also, according to an embodiment of the present invention, the transistors (e.g., the data transistors) provided in the demultiplexer are set to have a turned-on time or order in consideration of an emission efficiency of a light emitting device, thereby displaying an image with an improved picture quality.

Further, according to an embodiment of the present invention, the sizes of the initialization switching devices are set differently in correspondence with the turned-on time, so that it is possible to decrease the size of the initialization switching device, thereby securing a freedom of a circuit design. Also, the sizes of the initialization switching devices are decreased, so that voltage (or current) supplied via the initialization switching device is lowered, thereby reducing power consumption.

Although embodiments of the present invention have been shown and described, it would be appreciated by those skilled in the art that changes might be made in these embodiments without departing from the principles and spirit of the invention, the scope of which is defined in the claims and their equivalents.

What is claimed is:

1. A light emitting display comprising:

a scan driver for supplying scan signals to scan lines in sequence;

a data driver provided with a plurality of output lines and for supplying a plurality of data signals to the respective output lines while the scan signals are supplied;

an image displaying part comprising a plurality of pixels in regions crossed by the scan lines and a plurality of data lines;

a plurality of demultiplexers, each of the demultiplexers coupling a respective one of the output lines and comprising a plurality of data transistors adapted to supply a respective one of the data signals from the respective one of the output lines to more than one of the plurality of data lines; and a plurality of initializers respectively coupled to the plurality of data lines, each of the initializers comprising a plurality of initialization transistors each adapted to apply a predetermined voltage to a corresponding one of the plurality of data lines, wherein the plurality of initialization transistor have different channel widths in accordance with emission efficiencies of the pixels, and wherein an initialization transistor among the plurality of initialization transistors configured to have a shortest turned-on period has a channel width greater than that of another initialization transistor among the plurality of initialization transistors configured to have a longest turned-on period.

2. The light emitting display according to claim 1, wherein each of the pixels comprises a plurality of pixel transistors, and at least one of the pixel transistors is connected to function as a diode.

3. The light emitting display according to claim 1, further comprising a demultiplexer controller for controlling the demultiplexers to supply the plurality of data signals from each of the output lines to the plurality of data lines.

4. The light emitting display according to claim 1, wherein each of the demultiplexers is connected with at least three of the data lines, and the at least three of the data lines are connected to a red pixel including a red light emitting device, a green pixel including a green light emitting device, and a blue pixel including a blue light emitting device, respectively.

5. The light emitting display according to claim 1, wherein the channel width of each of the respective initialization transistors is set to become narrower as the turned-on period becomes longer.

6. The light emitting display according to claim 2, wherein the predetermined voltage is set to be supplied to and forward bias the at least one of the pixel transistors connected to function as the diode.

7. The light emitting display according to claim 2, wherein each of the pixels comprises:

a light emitting device;

a first transistor for controlling a current to be supplied to the light emitting device in correspondence with at least one of the data signals;

a storage capacitor connected to the first transistor and for storing a voltage corresponding to at least one of the data signals; and a second transistor connected to an $n^{th}$ scan line of the scan lines and a respective one of the data lines and for transmitting at least one of the data signals from the respective one of the data lines to the storage capacitor, where n is a natural number.

8. The light emitting display according to claim 3, wherein the data transistors provided in each of the demultiplexers are equal in number to the initialization transistors provided in each of the initializers.

9. The light emitting display according to claim 8 wherein the demultiplexer controller supplies control signals to turn on the plurality of data transistors in sequence while at least one of the scan signals is supplied.

10. The light emitting display according to claim 9, wherein the demultiplexer controller supplies initialization control signals to turn on the initialization transistors in each of the initializers before the data transistors in a respective one of the demultiplexer are turned on.

11. The light emitting display according to claim 10, wherein the demultiplexer controller supplies the initialization control signals to turn off each of the initialization transistors in each of the initializers at different times.

12. The light emitting display according to claim 11, wherein at least one of the initialization transistors is turned off before a respective one of the data transistors connected to a respective one of the data lines connected to the at least one of the initialization transistors is turned on.

13. The light emitting display according to claim 7, wherein the data transistors, the initialization transistors, and the second transistor are of a same transistor type.

14. The light emitting display according to claim 7, wherein each of the pixels further comprises:

a third transistor connected between the second transistor and the first transistor and having gate and drain terminals connected to each other;

a fourth transistor controlled by an $(n-1)^{th}$ scan line of the scan lines and connected to the third transistor and a second initialization power line; and a fifth transistor controlled by the $(n-1)^{th}$ line and connected to the light emitting device and the first transistor.

15. The light emitting display according to claim 7, wherein the predetermined voltage is lower than a lowest voltage of at least one of the data signals supplied from the data driver.

16. The light emitting display according to claim 7, wherein the predetermined voltage is lower than a voltage obtained by subtracting a threshold voltage of the at least one of the pixel transistors provided in each of the pixels and connected to function as the diode from a lowest voltage of the at least one of the data signals supplied from the data driver.

17. The light emitting display according to claim 4, wherein an order for turning on the data transistors receiving the respective one of the data signals is set to give a precedence to a selected one among the red light emitting device, the green light emitting device, and the blue light emitting device having a relatively high emission efficiency.

18. The light emitting display according to claim 17, wherein the order for turning on the data transistors is set to initially supply the respective one of the data signals to the green light emitting device and to lastly supply the respective one of the data signals to the blue light emitting device.

19. A demultiplexing circuit comprising:

a plurality of demultiplexers respectively coupled to a plurality of output lines of a data driver and comprising a plurality of data transistors adapted to supply a data signal from each of the output lines to more than one of a plurality of data lines; and a plurality of initializers respectively coupled to the plurality of data lines, each of the initializers comprising a plurality of initialization transistors each adapted to supply a predeteimined voltage to a corresponding one of the plurality of data lines, wherein the plurality of initialization transistors have different channel widths in accordance with emission efficiencies of pixels coupled to the data lines, and wherein an initialization transistor among the plurality of initialization transistors configured to have a shortest turned-on period has a channel width eater than that of another initialization transistor among the plurality of initialization transistors configured to have a longest turned-on period.

20. The demultiplexing circuit according to claim 19, wherein the data transistors provided in each of the demultiplexers are equal in number to the initialization transistors provided in each of the initializers.

21. The demultiplexing circuit according to claim 19, wherein the predetermined voltage is lower than a lowest voltage of at least one of the data signals supplied to at least one of the data lines.

22. The demultiplexing circuit according to claim 20, wherein the data transistors provided in each of the demultiplexers are turned on in sequence to supply a plurality of data signals to the plurality of data lines.

23. The demultiplexing circuit according to claim 22, wherein the initialization transistors provided in each of the initializers are turned on before the data transistors in a respective one of the demultiplexers are turned on, and the initialization transistors provided in each of the initializers are turned off at different times.

24. The demultiplexing circuit according to claim 23, wherein at least one of the initialization transistors is turned off before a respective one of the data transistors connected to a respective one of the data lines connected to the at least one of the initialization transistors is turned on.

25. The demultiplexing circuit according to claim 24, wherein the channel widths of the respective initialization transistors are set to become narrower as turned-on periods for applying the predetermined voltage of the respective initialization transistors become longer.

26. A method of driving a light emitting display, the method comprising:

supplying scan signals to a plurality of scan lines in sequence;

supplying a plurality of data signals to a plurality of output lines of a data driver while the scan signals are supplied;

turning on a plurality of data transistors connected to the plurality of output lines in sequence to supply the plurality of data signals to a plurality of data lines; and turning on a plurality of initializers respectively connected to the plurality of data lines before turning on the data transistors to supply an initialization power to the plurality of data lines, each of the initializers comprising a plurality of initialization transistors adapted to supply the initialization power an initialization transistor among the alit of initialization transistors configured to have a shortest turned-on period has a channel width greater than that of another initialization transistor among the plurality of initialization transistors configured to have a longest turned-on period, wherein the different channel widths of the plurality of initialization transistors are configured in accordance with emission efficiencies of pixels coupled to the data lines, wherein each of the output lines is connected with at least three of the data transistors, and at least three of the data lines connected with the at least three of the data transistors are connected with a red pixel including a red light emitting device, a green pixel including a green light emitting device and a blue pixel including a blue light emitting device, respectively, and wherein a turning-on order of the at least three of the data transistors is set to be based on emission efficiencies of the red light emitting device, the green light emitting device, and the blue light emitting device, with higher emission efficiencies taking precedence over lower emission efficiencies.

27. The method according to claim 26, wherein the initialization transistors are turned off at different times.

28. The method according to claim 26, wherein the turning-on order of the at least three of the data transistors is set to initially supply a respective one of the data signals to the green light emitting device and to lastly supply the respective one of the data signals to the blue light emitting device.

29. The method according to claim 26, wherein the plurality of data lines are greater in number than the plurality of output lines.

30. The method according to claim 27, wherein at least one of the initialization transistors is turned off before a corresponding one of the data transistors connected to a corresponding one of the data lines connected to at least one of the initialization transistors is turned on.

* * * * *

UNITED STATES PATENT AND TRADEMARK OFFICE

CERTIFICATE OF CORRECTION

PATENT NO. : 8,199,079 B2
APPLICATION NO. : 11/197752
DATED : June 12, 2012
INVENTOR(S) : Yang-Wan Kim et al.

It is certified that error appears in the above-identified patent and that said Letters Patent is hereby corrected as shown below:

In the Claims

| | |
|---|---|
| Column 19, Claim 1, line 41 | Delete "transistor"<br>Insert -- transistors -- |
| Column 20, Claim 14, line 52 | Before "line"<br>Insert -- scan -- |
| Column 21, Claim 19, line 18 | Delete "predeteimined"<br>Insert -- predetermined -- |
| Column 21, Claim 19, line 25 | Delete "eater"<br>Insert -- greater -- |
| Column 22, Claim 26, line 17 | Delete "power"<br>Insert -- power, wherein -- |
| Column 22, Claim 26, line 18 | Delete "alit"<br>Insert -- plurality -- |

Signed and Sealed this
Twenty-fifth Day of November, 2014

Michelle K. Lee

Michelle K. Lee
*Deputy Director of the United States Patent and Trademark Office*